US009901200B2

(12) United States Patent
Vanderstraeten

(10) Patent No.: US 9,901,200 B2
(45) Date of Patent: Feb. 27, 2018

(54) INTERMEDIATE ELEMENT FOR RECLOSING CAN

(71) Applicant: E.V.D.S. BVBA, Gentbrugge (BE)

(72) Inventor: Erwin Vanderstraeten, Gentbrugge (BE)

(73) Assignee: E.V.D.S. BVBA, Gentbrugge (BE)

( * ) Notice: Subject to any disclaimer, the term of this patent is extended or adjusted under 35 U.S.C. 154(b) by 0 days.

(21) Appl. No.: 14/766,357

(22) PCT Filed: Feb. 12, 2014

(86) PCT No.: PCT/EP2014/052761
§ 371 (c)(1),
(2) Date: Aug. 6, 2015

(87) PCT Pub. No.: WO2014/124992
PCT Pub. Date: Aug. 21, 2014

(65) Prior Publication Data

US 2016/0000246 A1 Jan. 7, 2016

Related U.S. Application Data

(60) Provisional application No. 61/763,623, filed on Feb. 12, 2013.

(30) Foreign Application Priority Data

Dec. 13, 2013 (EP) ..... 13197169

(51) Int. Cl.
*B65D 17/34* (2006.01)
*A47G 19/22* (2006.01)
*B65D 17/00* (2006.01)
*B65D 81/20* (2006.01)

(52) U.S. Cl.
CPC ..... *A47G 19/2272* (2013.01); *B65D 17/166* (2013.01); *B65D 81/2053* (2013.01); *B65D 2517/0004* (2013.01); *B65D 2517/0046* (2013.01)

(58) Field of Classification Search
CPC ..... B65D 17/166; B65D 2517/0046
USPC ..... 220/270
See application file for complete search history.

(56) References Cited

U.S. PATENT DOCUMENTS 4,190,174 A 2/1980 Haimowitz
4,609,123 A 9/1986 Poncy
5,810,189 A 9/1998 Baker
(Continued)

FOREIGN PATENT DOCUMENTS

AT 507950 A1 9/2010
JP H01-219051 A 11/1989
(Continued)

OTHER PUBLICATIONS

Japanese Office Action dated Sep. 5, 2017, for JP 2015-557418.
(Continued)

*Primary Examiner* — Shawn M Braden
(74) *Attorney, Agent, or Firm* — Bacon & Thomas, PLLC

(57) ABSTRACT

An intermediate element for a metal beverage can, for carbonated drinks, where the intermediate element has a shut-off valve and is to be attached to the can end of the can shielding the can end from the interior of the can.

18 Claims, 24 Drawing Sheets

(56) References Cited

U.S. PATENT DOCUMENTS

| | | | | |
|---|---|---|---|---|
| 8,336,726 | B2 * | 12/2012 | Ramsey | B65D 17/506 220/254.3 |
| 2010/0133275 | A1 * | 6/2010 | Phillips | B65D 7/40 220/270 |
| 2013/0020326 | A1 | 1/2013 | Thielen et al. | |

FOREIGN PATENT DOCUMENTS

| | | | | |
|---|---|---|---|---|
| JP | H01-279049 | A | 11/1989 | |
| WO | 2005/056400 | A1 | 6/2005 | |
| WO | 2010/094793 | A2 | 8/2010 | |
| WO | 2012/028694 | A1 | 3/2012 | |
| WO | WO 2012028694 | A1 * | 3/2012 | B65D 17/166 |
| WO | 2012/049280 | A1 | 4/2012 | |

OTHER PUBLICATIONS

International Search Report (ISR) dated May 20, 2014, for PCT/EP2014/052761.
Written Opinion dated May 20, 2014, for PCT/EP2014/052761.

* cited by examiner

INTERMEDIATE ELEMENT FOR RECLOSING CAN

FIELD OF THE INVENTION

The present invention relates to a container such as a can for a food product, especially a beverage, as well as a method of manufacturing the container or can. The container or can is especially suitable for carbonated beverages or drinks. The container or can can be provided with means for easily reclosing after the first opening.

BACKGROUND TO THE INVENTION

Metal beverage cans usually have a pull tab (working as a lever mechanism) to allow for the opening of the can along a pre-determined shallow groove. This design allows venting the excess pressure in the can when it is opened. As the tab is lifted, first a vent score is severed, allowing the gases in the can to be released, and then the aperture score is ruptured, which defines an aperture through which the contents of the beverage can may be dispensed. The groove has the shape of a non-closed loop, so that when pressure is applied by the lever to rip the metal along the groove, the metal tab that is ripped off remains attached to the top of the can, even when the lever is returned to its original position.

With existing cans, a permanent opening is formed by these manipulations, so that the contents of the can may be drunk, but on the other hand carbon dioxide may escape and spills may occur.

WO 2012/049280, WO 2010/094793 and AT 507950 A1 disclose a reclosable can comprising an intermediate element and a seal arranged on the intermediate element, wherein the intermediate element is arranged between the can end and the interior of the can.

U.S. Pat. No. 4,609,123 discloses a beverage can with a sanitary reclosable lid. U.S. Pat. No. 4,190,174 discloses a drinking receptacle cover with a lip operated valve. WO 2005/056400 A1 discloses a reclosable cap for a beverage container.

WO 2012/028694 A1 discloses a new reclosing can for a food product.

SUMMARY OF THE INVENTION

The present invention provides an alternative container, e.g. a can for food products, especially beverages such as carbonated drinks. The container according to the present invention comprises improvements over the container disclosed in WO 2012/028694, "Reclosing can for food product", which is included herein by reference, in its entirety.

The container or can will be described below especially when used for beverages, particularly carbonated drinks. It will be clear from the description however that the can may also be used for other food products, such as instant soup, instant coffee, oil, honey, sauces, dairy products such as milk or yoghurt, et cetera.

One advantage of a container or can according to the invention is that it can easily be produced, and that it is suitable for mass production. In comparison with a traditional can, only the can end is different. Thus, a traditional production line of cans can be modified to produce the container or can, e.g. by replacing the production steps for the traditional can end by the production steps for the can end according to the invention; e.g. by adaptation of the tooling for the production line. The production steps and tooling for the can body and for attaching the can end to the can body can remain unchanged. Moreover, a can end in accordance with the invention requires only a small number of parts.

Preferred embodiments of a can end in accordance with the present invention include an improved embodiment of an intermediate element as disclosed in WO 2012/028694.

In some embodiments, the intermediate element is adapted to be immovably attached to the can end for shielding the can end circumferentially from the interior of the can before and during use of the can by a customer, i.e. when drinking or pouring the contents of the can by the customer; this shielding the can end circumferentially from the interior of the can prevents the contents of the can from circumferentially passing the intermediate element to contact the can end. That the intermediate element is configured to be immovably attached to the can end as stated, means that when the intermediate element is attached to the can end, the can end is shielded around its circumference, as opposed to at its center, by the intermediate element; also when the can comprising the can end is used by a customer, for drinking or pouring, the contents of the can cannot pass the intermediate element circumferentially and then contact the can end. Of course, when drinking, the contents of the can will pass the intermediate element (otherwise the customer would not be able to drink), but the contents will not pass the intermediate element circumferentially, but in another zone, e.g. near the center of the intermediate element. In embodiments in which a sealing element is present, as discussed below, the sealing element may shield the can end circumferentially from the interior of the can, once the intermediate element is attached to a can end, and once the can end is part of a can.

In some particular embodiments, the intermediate element has a circumferential portion for being seamed to the can end and to the can body—seaming is the operation that is customarily used to attach a standard can end to a can body. Usually, the seaming operation results in a so-called double seam (as known in the art). The circumferential portion may be adapted for preventing, after the seaming operation, the contents of the can from circumferentially passing the intermediate element to contact the can end.

An advantage of some embodiments is that the intermediate element shields the can end from the interior of the can. Thus, the can end, which is often made of aluminum, may be made thinner, e.g. 0.2 mm instead of 0.3 mm, and is thus cheaper. The can end then essentially acts as a safety seal: before the can is opened, the consumer can immediately see that the can is still intact, and has not been tampered with—which is not the case with several other types of resealable cans. The can end is thus decoupled from the interior of the can by the intermediate element. In embodiments, the can has two seals that operate independently of each other: the can end acting as a first safety seal and the intermediate element acting as a second seal. The intermediate element and the corresponding sealing elements allow the can to withstand an internal pressure of e.g. 6.2 bar, in one embodiment, as is discussed below under the heading "Experiments". A metal beverage can comprising such an intermediate element is stronger than a traditional beverage can.

An intermediate element may include a sealing element, for shielding the can end circumferentially from the interior of the can. This sealing element is different from the seal of the shut-off valve that is disclosed in WO 2012/028694. In some embodiments, the sealing element is part of the intermediate element; this is e.g. the case when the intermediate element comprises a circumferential portion for being seamed to the can end and to the can body—the circumferential portion of the intermediate element then acts as a sealing element, and is in fact a sealing element, that is part of the intermediate element and that shields the can end circumferentially from the interior of the can. In other embodiments, the sealing element for shielding the can end circumferentially from the interior of the can is attached to the intermediate element.

The sealing element may be configured for preventing the contents of the can from passing the intermediate element to contact the can end.

In this document, that an element is at least substantially made of at least one specified material, e.g. of at least one metal, or e.g. of at least one plastic material, means that the element is made of at least 70% of the specified material, preferably of at least 80% of the specified material, more preferably of at least 90% of the specified material and most preferably of at least 95% of the specified material, wherein the percentages are percentages by volume.

In some embodiments, the intermediate element is at least substantially made of at least one plastic material. The intermediate element may be manufactured by injection molding. An advantage of injection molding is that more than one material may be used in one and the same injection molding step: e.g. in one embodiment the intermediate element may be made of polyacetal, and the sealing element, if a separate sealing element, attached to the intermediate element, is present, may be made of silicone. In other embodiments, the intermediate element is at least substantially made of at least one metal. In an embodiment, the intermediate element is made of aluminum. The aluminum may have a thickness of less than 0.2 mm.

In embodiments wherein the intermediate element is at least substantially made of at least one plastic material, and when seaming the intermediate element to the can end and to the can body, the layer of silicone that is traditionally applied at the seaming location when seaming the can end to the can body in a traditional can, may be omitted in some embodiments, as is discussed further below with reference to FIG. 2. In embodiments wherein the intermediate element is at least substantially made of at least one metal, and when seaming the intermediate element to the can end and to the can body, a layer of silicone may be applied between the intermediate element and the can end and a layer of silicone may be applied between the intermediate element and the can body.

The intermediate element may be attached to the can end in different ways: by an adhesive, or by riveting, or by clamping, or by snapping, or by crimping, or by seaming, or by a combination of these.

In some embodiments, the intermediate element comprises a shut-off valve for sealing the drinking or pouring aperture of the can. The shut-off valve may be part of the intermediate element. The shut-off valve may be coupled to the intermediate element. In particular embodiments, the shut-off valve is at least substantially made of at least one plastic material. In other embodiments, the shut-off valve is at least substantially made of at least one metal.

In an embodiment, the shut-off valve is configured to seal the drinking or pouring aperture of the can by contacting the intermediate element.

In some embodiments, the intermediate element has a side facing the contents of the can, or thus a side for contacting the contents of the can before the can is used by the customer, and the shut-off valve is configured to seal the drinking or pouring aperture by contacting that side of said intermediate element.

In some embodiments, the intermediate element comprises an elastic resilient element for resiliently operating the shut-off valve. The shut-off valve may be part of the elastic resilient element. The shut-off valve may be coupled to the elastic resilient element.

The elastic resilient element may be a two-part elastic resilient element. The first part may be a flat elastic element or a wire spring means. The second part may be a flat elastic element or a wire spring means. Such a flat elastic element may be made of a plastic material or of a metal such as steel. Such a wire spring means made be made of a metal, e.g. of steel.

In some embodiments, the intermediate element is at least substantially made of at least one plastic material, and has a circumferential portion that is adapted to be seamed between the can end and the can body, in a seaming operation as known in the art. The seaming operation, which preferably results in a double seam, attaches the can end, the intermediate element and the can body to each other. The can end and the can body may be made of metal. The intermediate element may comprise a shut-off valve for sealing the drinking or pouring aperture of said can. The intermediate element may comprise an elastic resilient element for resiliently operating the shut-off valve. The shut-off valve may be configured to seal the drinking or pouring aperture by contacting the intermediate element.

In embodiments, the circumferential portion has a thickness in the range 0.10 mm to 0.15 mm. In other embodiments, the circumferential portion has a thickness in the range 0.05 mm to 0.15 mm.

An intermediate element in accordance with the invention may be used in combination with a reclosing can having an opening and closing mechanism as disclosed in WO 2012/028694, and particularly in combination with a can end wherein, after removal of the cap top, the cap top is configured to remain located on top of the shut-off valve.

An intermediate element in accordance with the invention may be used in combination with a raised lip-contact portion as disclosed in WO 2012/028694.

The present invention also includes a can end comprising an intermediate element according to the invention and a metal beverage can comprising such a can end. The present invention also includes a method for producing such a metal beverage can. The present invention further includes a method for opening and for using such a metal beverage can by a customer.

BRIEF DESCRIPTION OF THE DRAWINGS

The invention will be described, by way of example only, with reference to the accompanying drawings, wherein.

DETAILED DESCRIPTION OF THE INVENTION

Figure 1A:
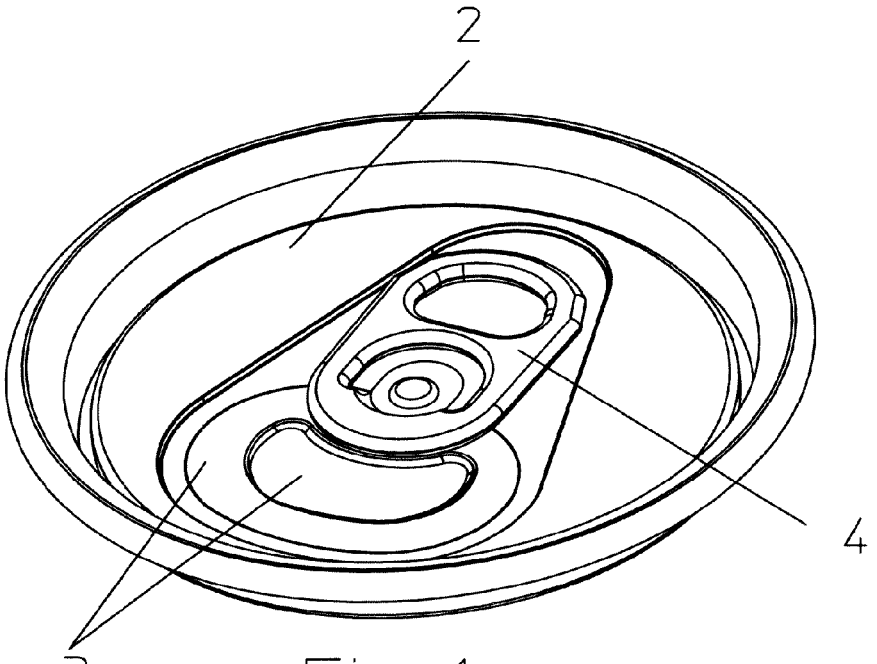
FIGS. 1*a* and 1*b* show 3D views of an embodiment of a can end that includes an intermediate element; the can end is seen from the top in FIG. 1*a* and from the bottom in FIG. 1*b;*

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Figure 1B:
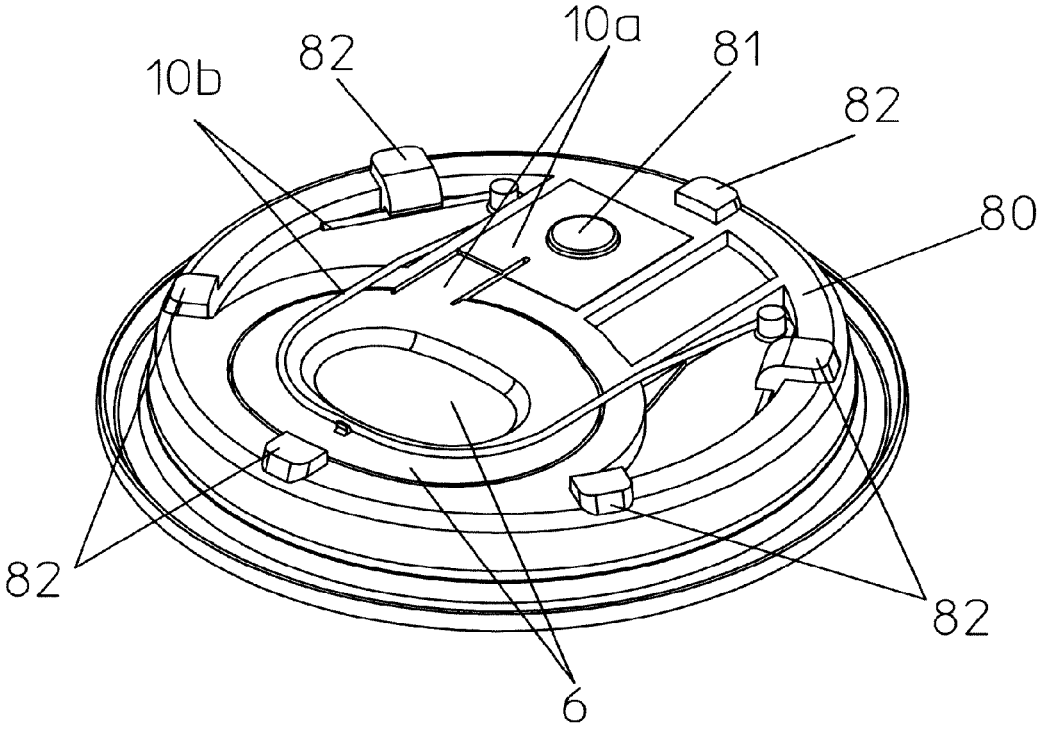

FIGS. 1*a* and 1*b* show a can end 2 of a container or can, e.g. a re-sealable beverage can. FIG. 1*a* shows a 3D top view of the can end, and FIG. 1*b* shows a 3D bottom view of the can end 2 (facing the interior of the can or container). The can end is often produced in aluminum. This material does not represent a limitation to the invention, e.g. the can end 2 in accordance with the invention may be made of steel. The invention may be applied to different standard containers such as beverage cans and sizes, as well as to so-called "slim" and "super sized" cans. Other designs of openings such as drinking or pouring openings may be used as well. In an embodiment, the edge of the can end 2 is standard, especially the way it has to be assembled on the can body 1 after filling with the food product.

In the embodiment shown in FIGS. 1*a* and 1*b*, the central part of the can end 2 has a tear panel 3, called the cap top in this document, which is very similar to the pull-off part of a standard beverage can end. As in a known, traditional beverage can, the cap top 3 can be torn off along a preformed shallow groove or other form of mechanical weakness, by pulling at the pull tab 4, which works as a lever. The opening that is thus created serves as a pouring or drinking opening, as in a traditional beverage can. However, in a traditional beverage can the cap top remains attached to the can, whereas in the shown embodiment the cap top 3 is torn completely from the can end along the groove. After tearing off the cap top 3, in the shown embodiment the cap top 3 remains attached to a shut-off valve 6 (shown in FIG. 1*b*), which is configured to reseal the pouring or drinking opening after drinking, by the action of an elastic resilient element 10*a*, 10*b*. The elastic resilient element is described in detail further below. The cap top 3 may be attached to the shut-off valve 6 in several ways, e.g. by means of staples as described in patent application WO 2012/028694 A1 (mentioned already above) in FIGS. 9*a* and 9*b* (the staples have reference sign 36 in FIG. 9*b*) and the corresponding description, on page 15, first paragraph, of that patent application. Of course cap top 3 may be fastened in other ways to shut-off valve 6, such as for example by means of an adhesive, or by riveting, or by a combination of these, or by another fastening method as known in the art. In the embodiment shown in FIGS. 1*a* and 1*b*, before it is opened for the first time, the can is a closed can just like a traditional closed can. It is opened by making a rupture through metal, as is the case for a traditional can, and it is thus as leak-proof and tamper-proof as a traditional can. Many other existing re-sealable cans rely on other opening mechanisms, e.g. on opening by a rotation, and they are often not at all as leak-proof.

In the embodiment shown in FIG. 1*b*, an intermediate element 80 is attached to the can end 2. The use of such an intermediate element has several advantages, as discussed in detail further above in this document. In the embodiment shown in FIG. 1*b*, the intermediate element 80 is positioned between the can end 2 and the elastic resilient element 10*a*, 10*b*. The shown elastic resilient element comprises two parts: a first element 10*a*, which is a flat elastic element in this embodiment, and a second element 10*b*, which is a wire spring means in this embodiment. Further, the intermediate element 80 may have a plurality of protrusions 82, six protrusions 82 in FIG. 1*b*. Thanks to these protrusions 82, a set of can ends can be stacked easily on top of each other, as discussed further below, in connection to FIGS. 14 to 17. In other embodiments, intermediate element 80 has more or less protrusions, for example three protrusions.

Figure 2:
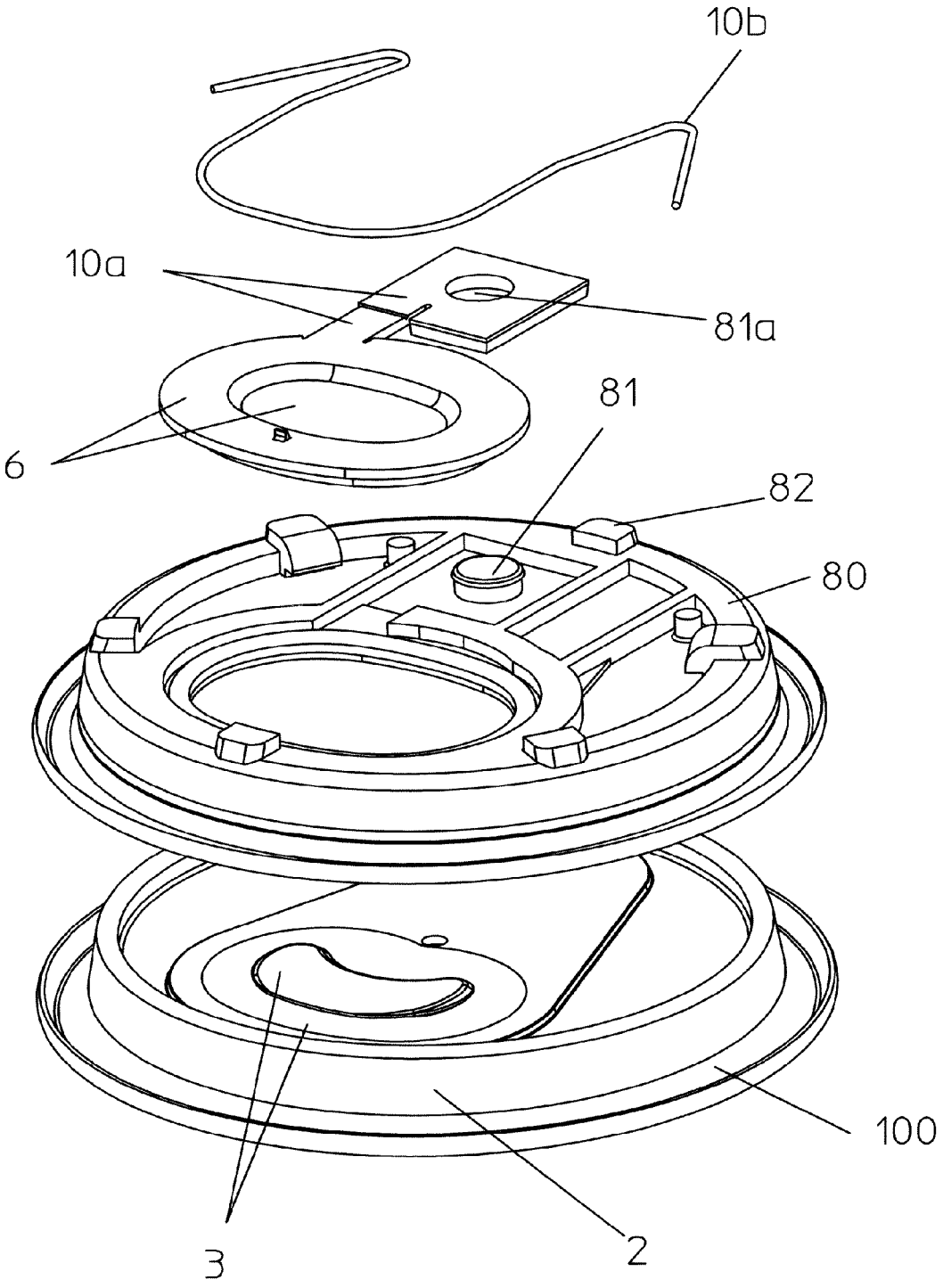
FIG. 2 shows the elements of the embodiment of FIGS. 1*a* and 1*b* separately.

FIG. 2 shows the elements of the embodiment of FIGS. 1*a* and 1*b* separately. Intermediate element 80 has a mushroom element 81, that fits into hole 81*a*, to attach shut off valve 6 and flat elastic element 10*a* to the intermediate element 80. FIG. 2 also shows the location 100 where, in a traditional can, a layer of silicone material is applied; it is an advantage of some embodiments of the invention that this layer can be omitted.

Figure 3A:
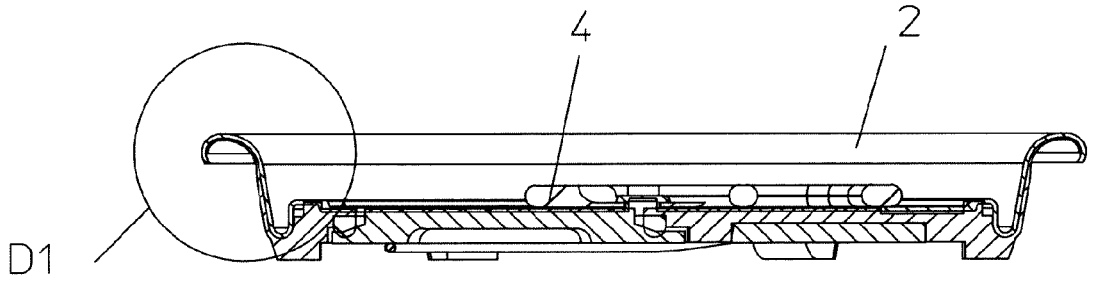
FIGS. 3*a* and 3*b*, and FIGS. 4*a* and 4*b*, show sectional views that illustrate how an intermediate element is attached to a can end in one embodiment.
Figure 3B:
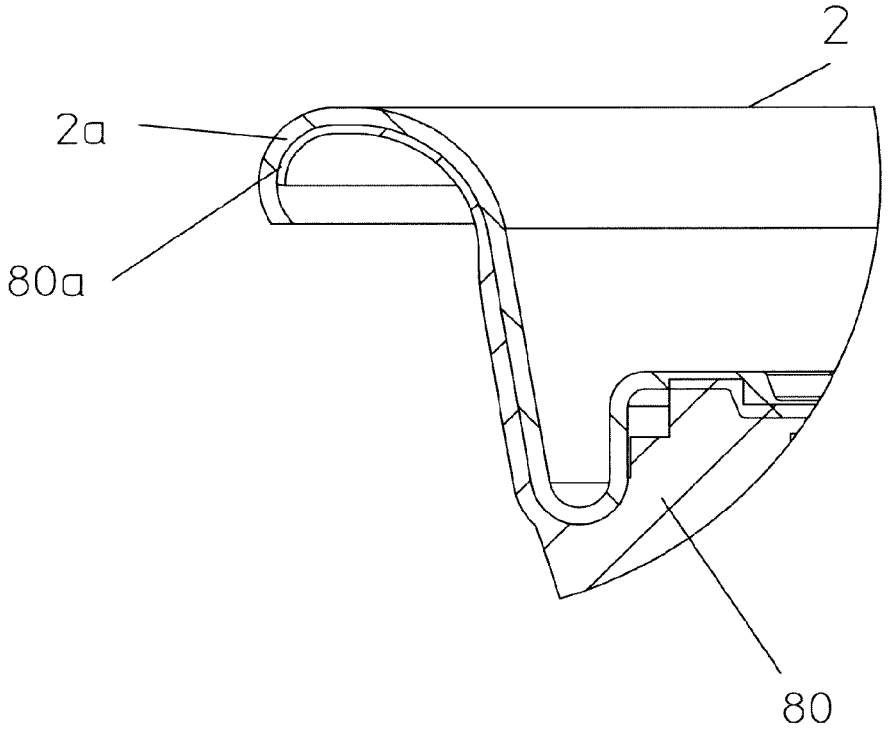
Figure 4A:
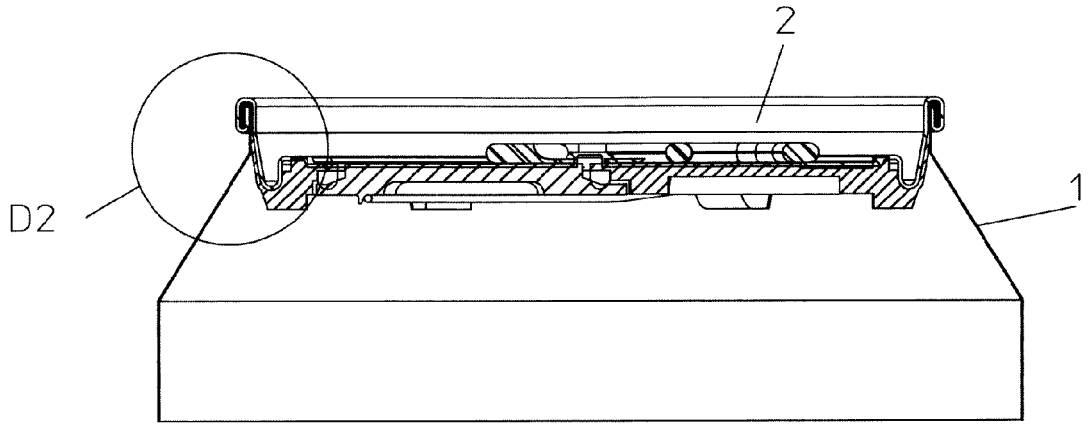
Figure 4B:
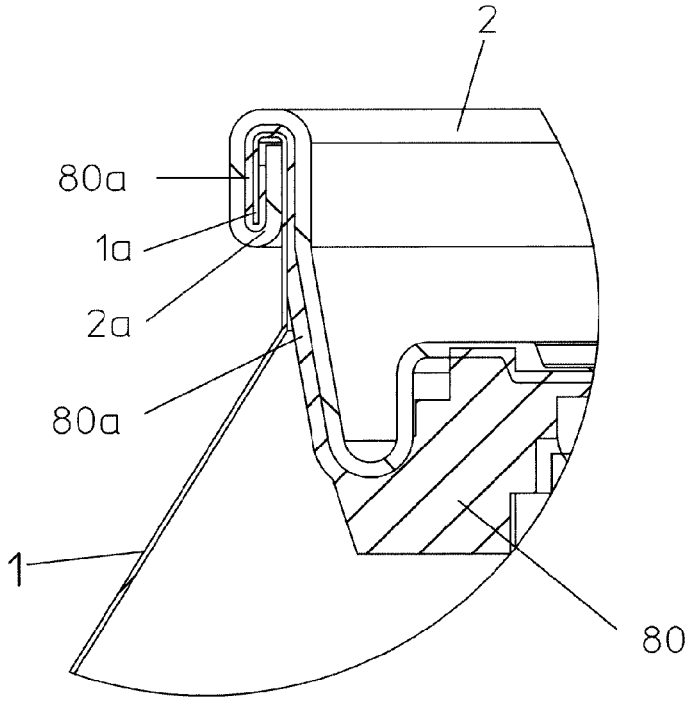

FIGS. 3 *a*, 3*b*, 4*a* and 4*b* show an embodiment wherein the intermediate element 80 is attached to the can end 2 by seaming. FIGS. 3*a* and 3*b* show the situation before the seaming operation, while FIGS. 4*a* and 4*b* show the situation after the seaming operation, when can end 2 is attached to can body 1. FIG. 3*b* shows the enlarged detail D1 of FIG. 3*a*, while FIG. 4*b* shows the enlarged detail D2 of FIG. 4*a*. The circumferential portion 80*a* of intermediate element 80 as shown in FIG. 3*b* is attached to the end 2*a* of can end 2 by the seaming operation. FIG. 4*b* shows how the end 1*a* of can body 1 is attached to the end 2*a* of can end 2 and to the circumferential portion 80*a* of intermediate element 80, thus attaching intermediate element 80 to can end 2 by the seaming operation. As is shown in FIGS. 4*a* and 4*b*, the intermediate element 80 thus shields the can end 2 from the interior of the can. The circumferential portion 80*a* of intermediate element 80 thus acts as a sealing element, is in fact a sealing element, that is part of intermediate element 80, and that shields the can end circumferentially from the interior of the can. In one embodiment, the circumferential portion 80*a* of intermediate element 80 has a smaller thickness, e.g. a thickness of 0.15 mm, than the thickness of the intermediate element 80. Further, the circumferential portion 80*a* of the intermediate element 80 may be made of a different plastic than the intermediate element 80 itself; the circumferential portion 80*a* may e.g. be made of a ductile plastic material. The intermediate element 80 including its circumferential portion 80*a* may be made by injection molding.

Figure 5A:
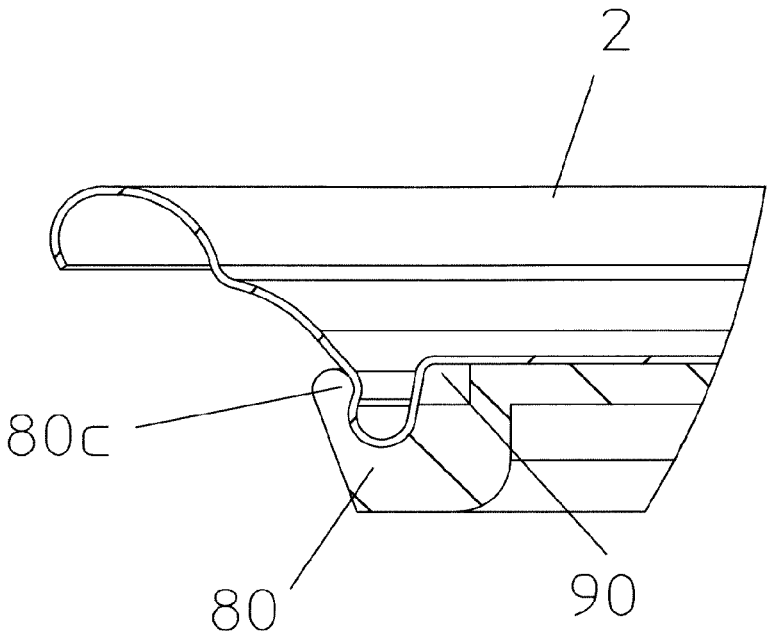
FIGS. 5*a* and 5*b* show sectional views of other embodiments of an intermediate element 80.
Figure 5B:
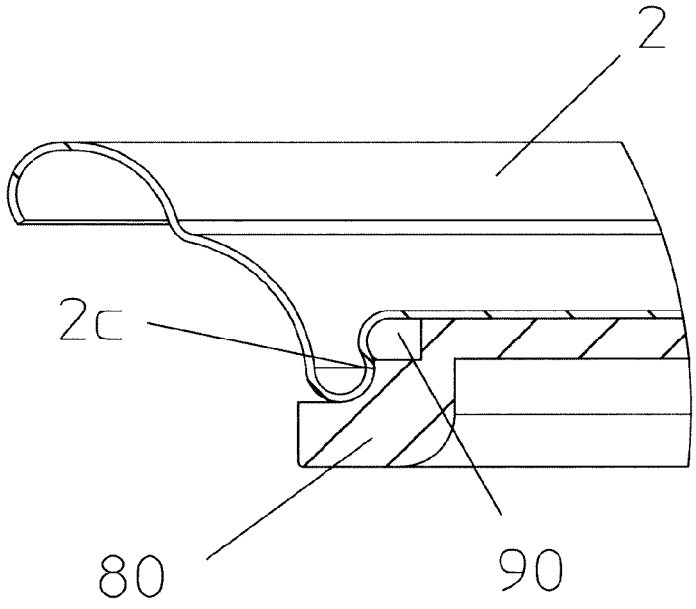

FIG. 5*a* and FIG. 5*b* show other embodiments of an intermediate element 80. In these embodiments, a sealing element 90 is attached to the intermediate element 80, e.g. by clamping and/or by an adhesive. The intermediate element 80 is attached to the can end 2 by a snap system. In the embodiment of FIG. 5*a*, edge 80*c* of intermediate element 80 snaps behind can end 2, while in the embodiment of FIG. 5*b*, sealing element 90 snaps behind can end 2 at location 2*c*. Also in these embodiments, the intermediate element 80 shields the can end 2 from the interior of the can. Further, sealing element 90 prevents the contents of the can from circumferentially passing the intermediate element 80 to contact the can end 2.

Figure 6:
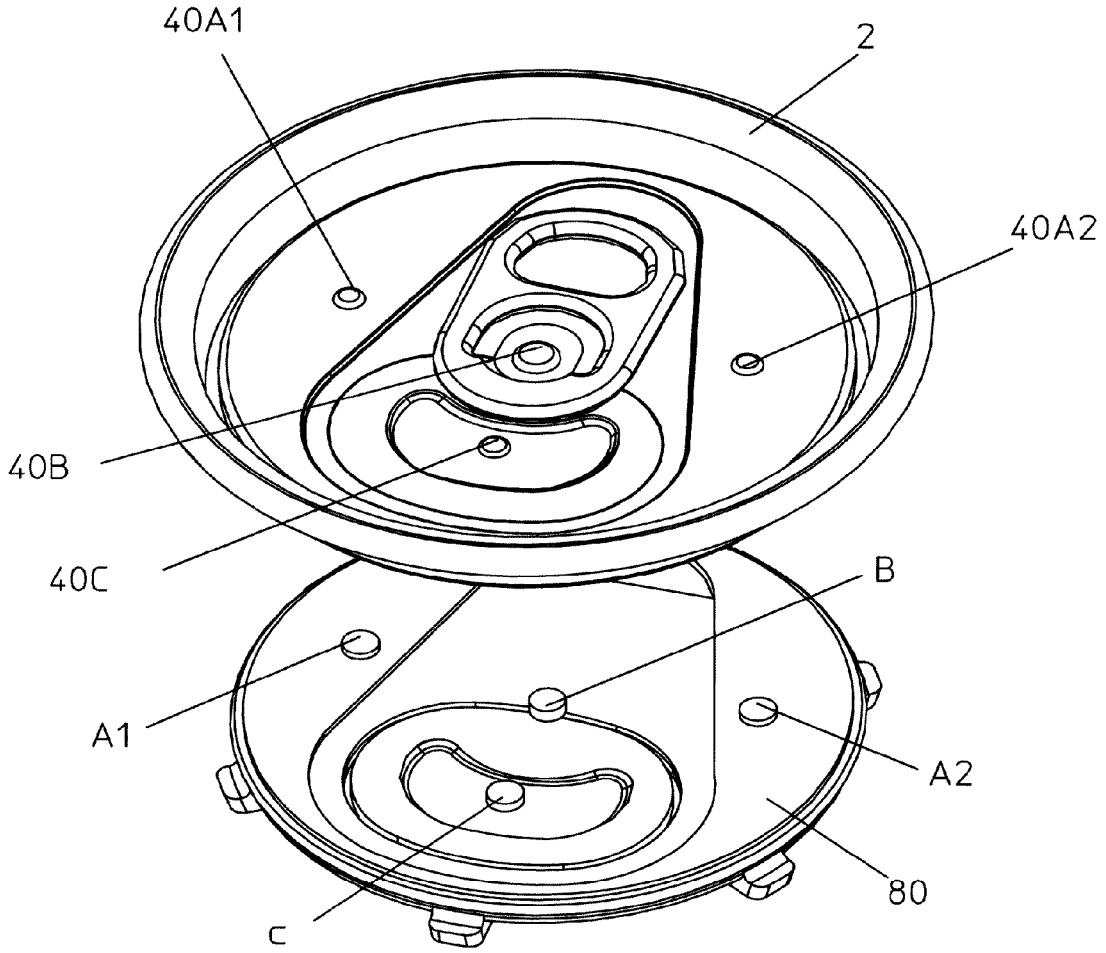
FIG. 6 is a 3D view illustrating how an intermediate element is attached to a can end in another embodiment.

Intermediate element 80 may also be attached to can end 2 in other ways. The attachment may be by means of an adhesive. The attachment may also be done by riveting, as shown in FIG. 6. Intermediate element 80 has mushroom elements, called simply mushrooms in this document, A1, A2, B and C, that fit in respectively the corresponding cavities 40A1, 40A2, 40B and 40C of can end 2. The mushrooms are then fixed in the corresponding cavities by riveting. Mushroom B and cavity 40B also serve to fix the pull tab to the can end. Not all these mushrooms and corresponding cavities have to be present together; e.g. mushrooms A1, A2 and B may be present, or mushrooms A1, A2 and C, or mushrooms A1, A2, B and C.

Figure 7A:
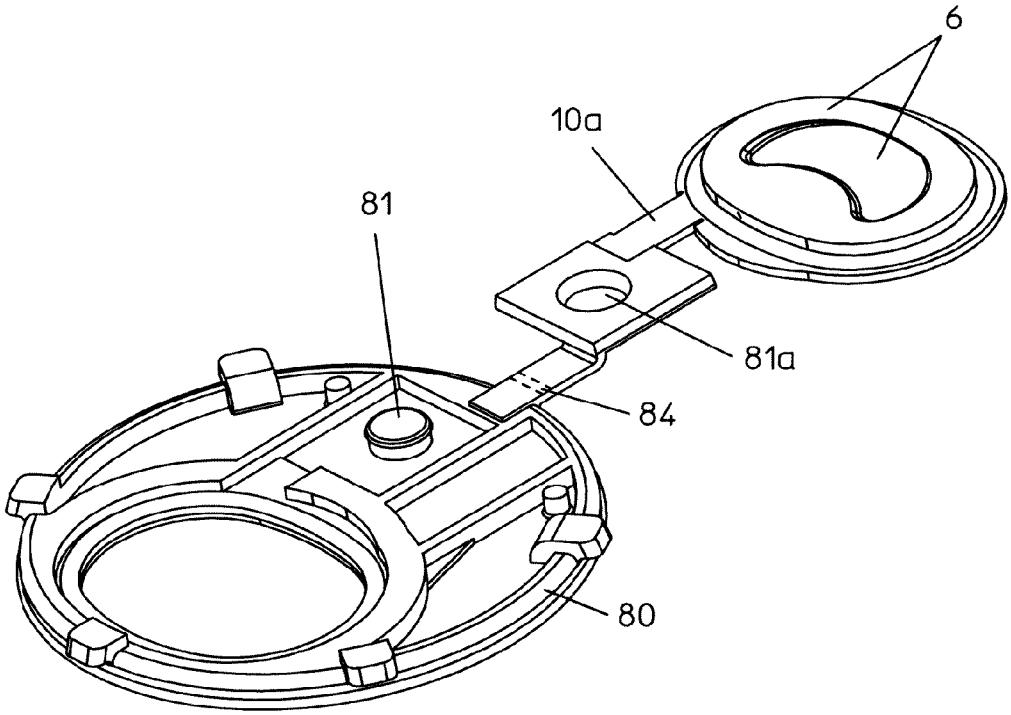
FIGS. 7*a* and 7*b* shows a 3D view of yet another embodiment of an intermediate element.
Figure 7B:
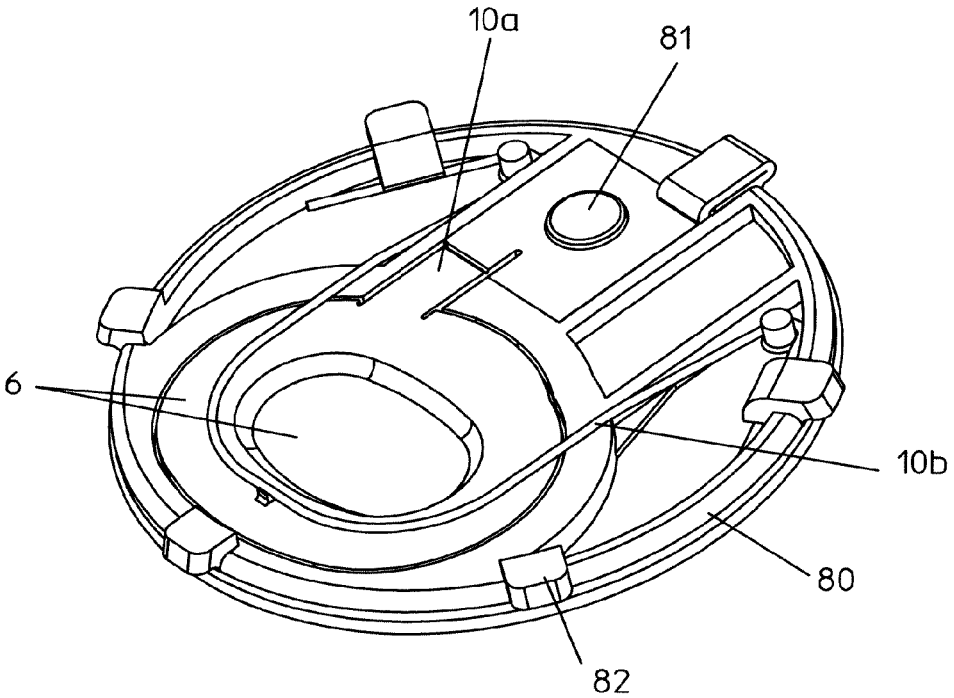

FIGS. 7*a* and 7*b* show an embodiment wherein the intermediate element 10*a* and the shut-off valve 6 are made in a single piece, e.g. by a single injection molding operation (the injection molded piece may however by made of e.g. two different materials). Shut off valve 6 is then bent around bending line 84 in FIG. 7*a*, and mushroom 81 is snapped into hole 81*a*. In a particular embodiment, additional wire spring means 10*b* may be added, to obtain the configuration shown in FIG. 7*b*.

Figure 8:
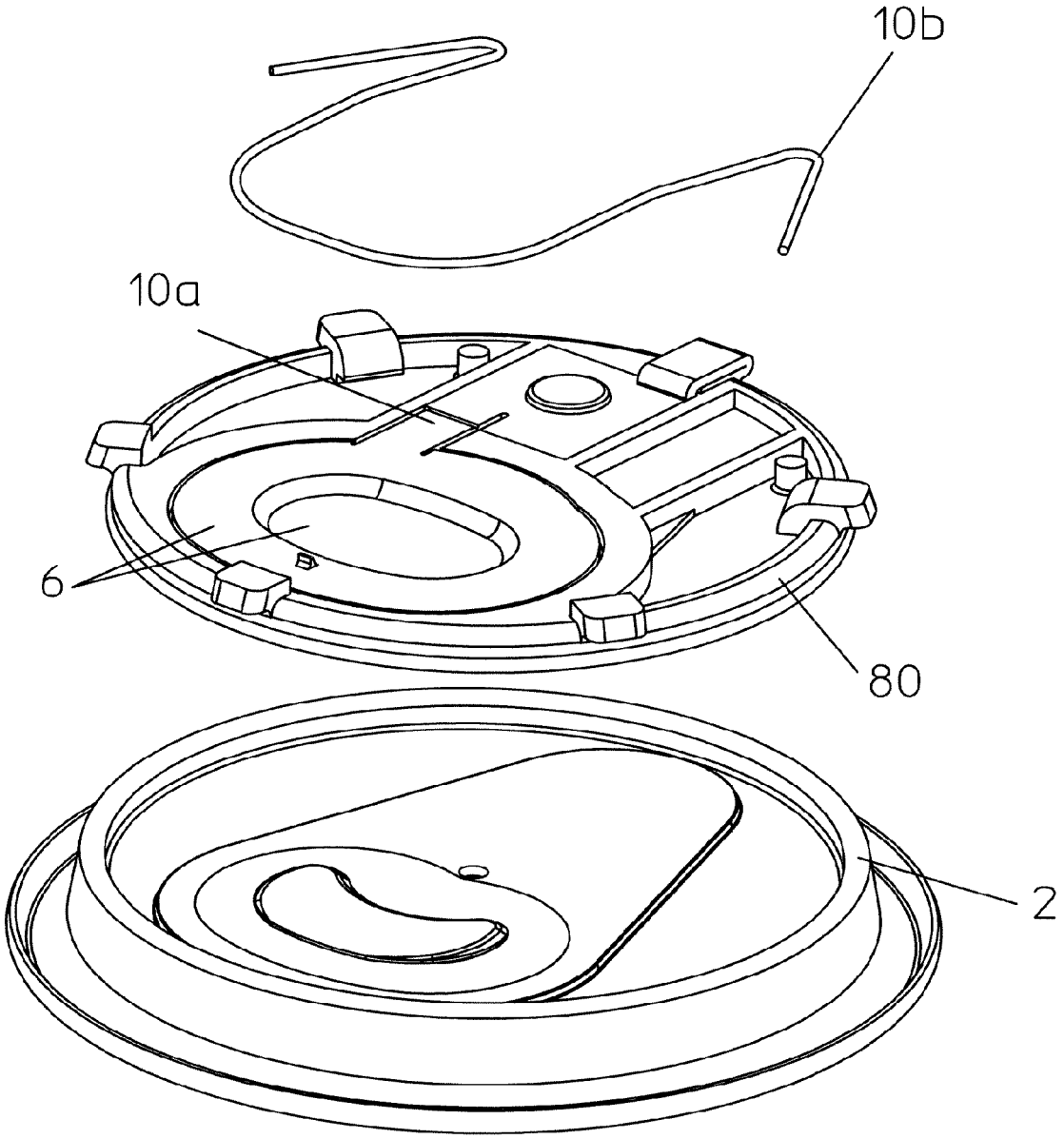
FIG. 8 shows the separate elements for the embodiment of FIGS. 7*a* and 7*b;*

FIG. 8 shows the separate elements of the embodiment shown in FIG. 7*b*, together with can end 2.

Figure 9A:
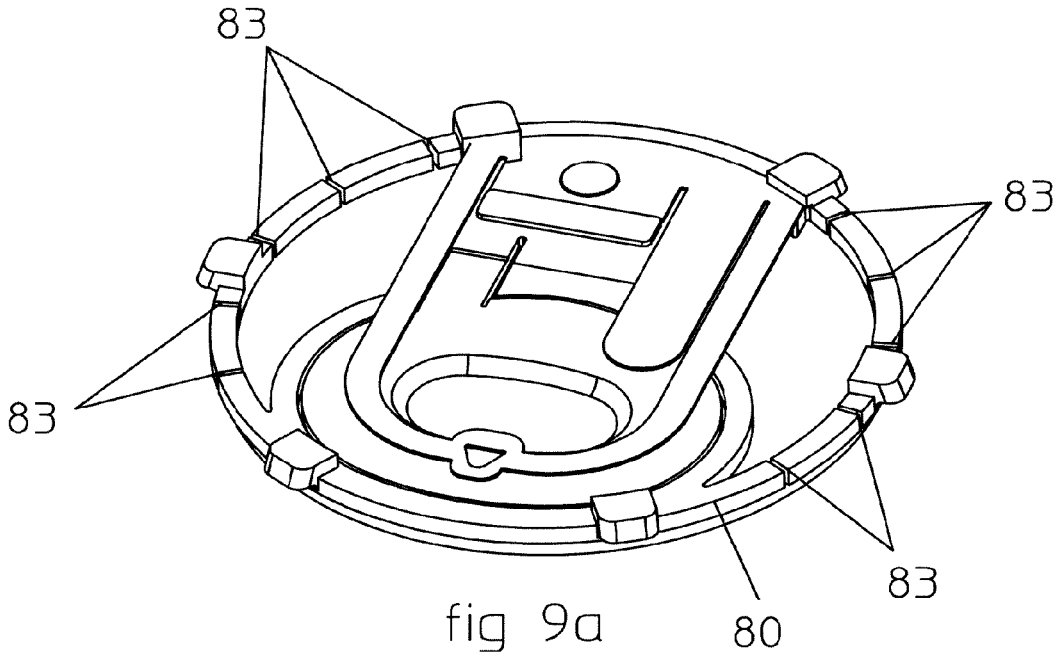
FIG. 9*a* and FIG. 9*b* are 3D views of still other embodiments of an intermediate element.

FIG. 9*a* shows an embodiment wherein the intermediate element 80 comprises weakenings 83. In some embodiments, these weakenings 83 may be useful to allow deformation of the intermediate element 80, e.g. when a can would be heated to a high temperature (e.g. when the can is in the sun in a car). The high temperature will cause the pressure in the can to increase, and this high pressure will then be relieved thanks to the deformation.

Figure 9B:
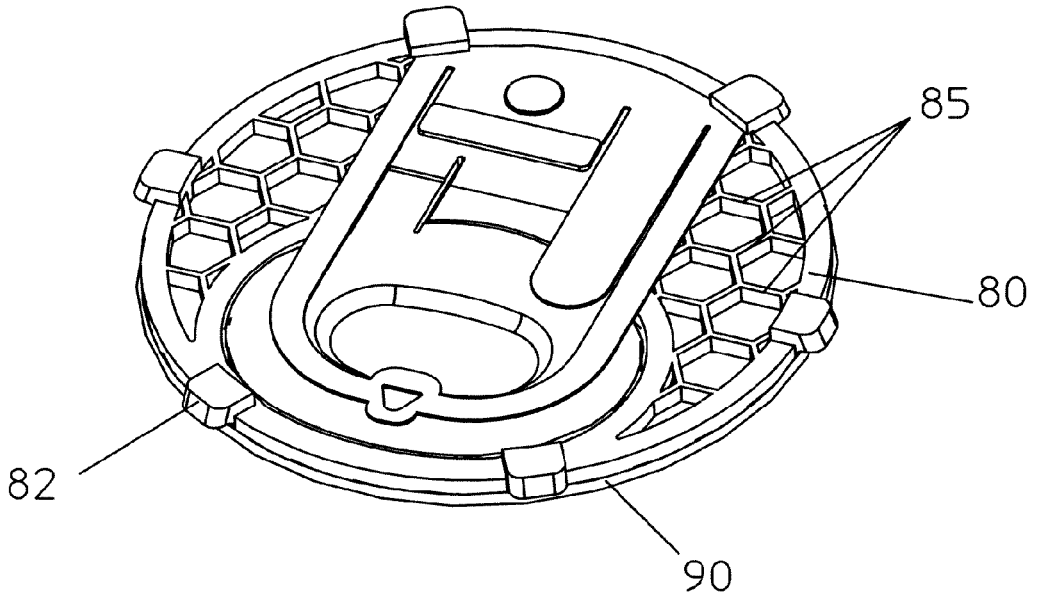

FIG. 9*b* shows an embodiment wherein the intermediate element 80 comprises a honeycomb structure 85. The weight of the intermediate element may thus be decreased, while still maintaining high strength. The embodiment of FIG. 9*b* also shows a sealing element 90.

Figure 10:
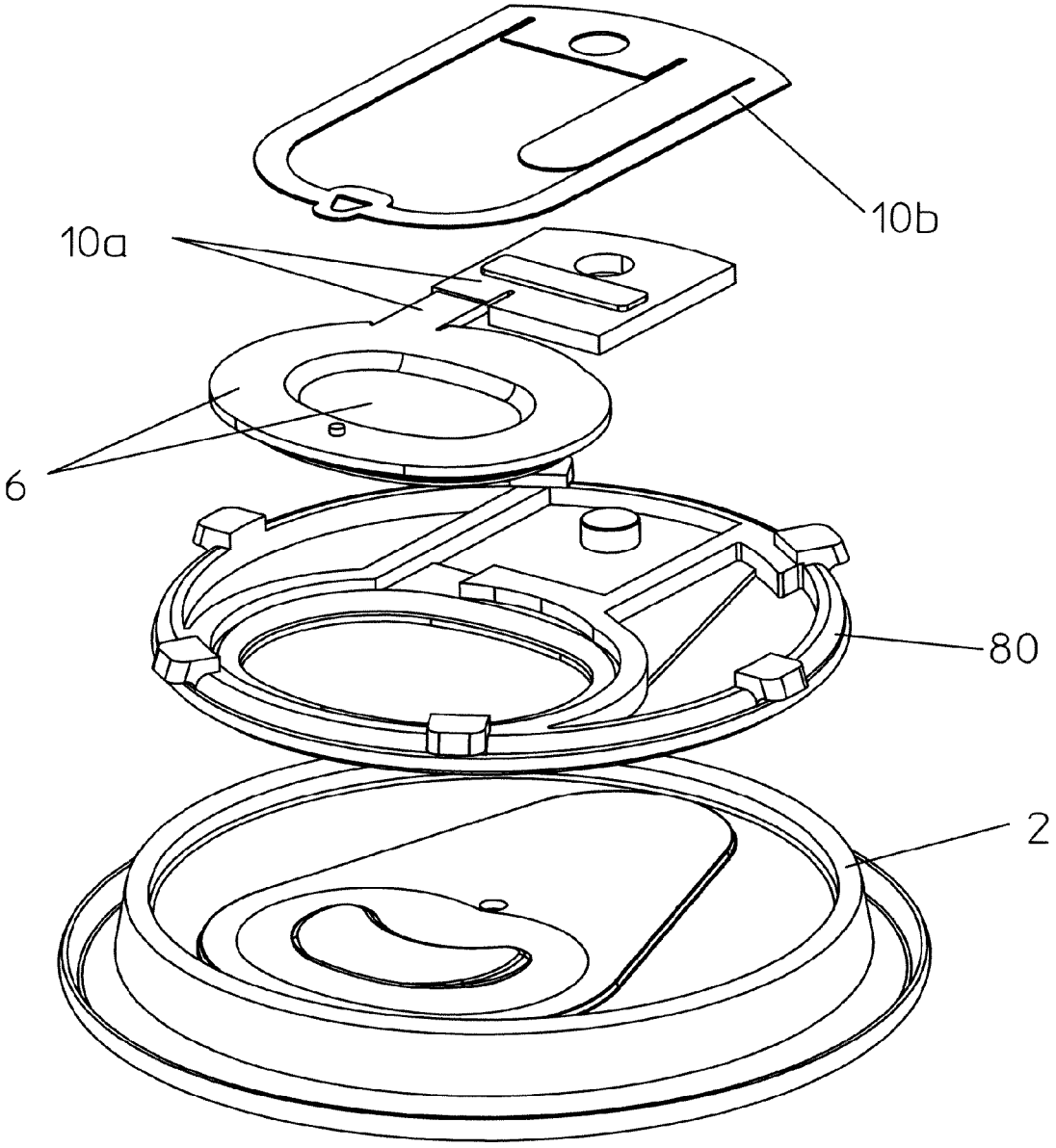
FIG. 10 is a 3D view showing the separate elements of another embodiment of an intermediate element.

FIG. 10 shows the separate elements of an embodiment comprising a two-part elastic resilient element wherein the first part is a flat elastic element 10*a* and the second part is also a flat elastic element, or plate spring means, 10*b*. The plate spring means 10*b* may be made of metal, e.g. from steel.

Figure 11:
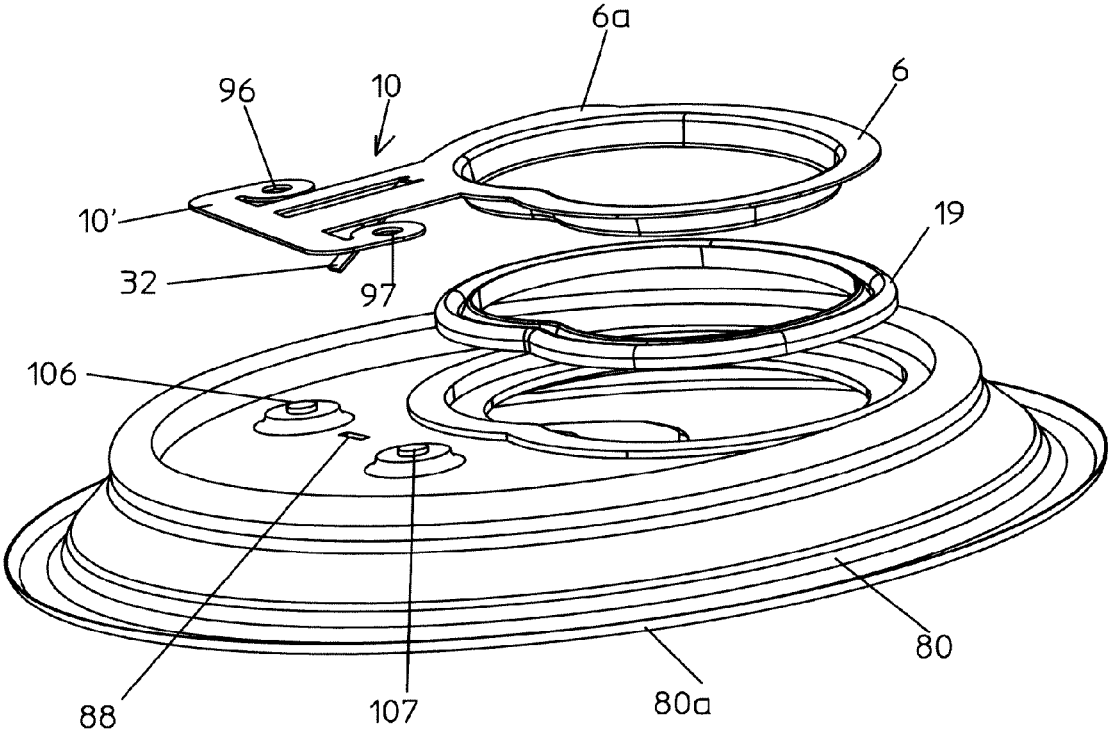
FIGS. 11 to 13 show 3D views illustrating yet another embodiment of an intermediate element.
Figure 12:
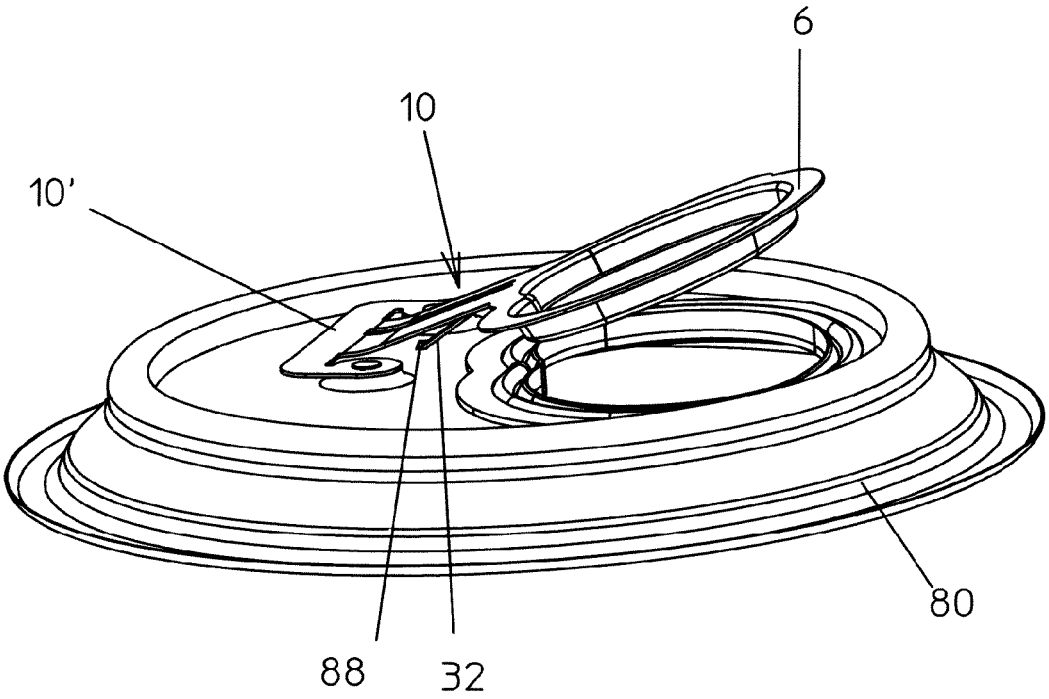
Figure 13:
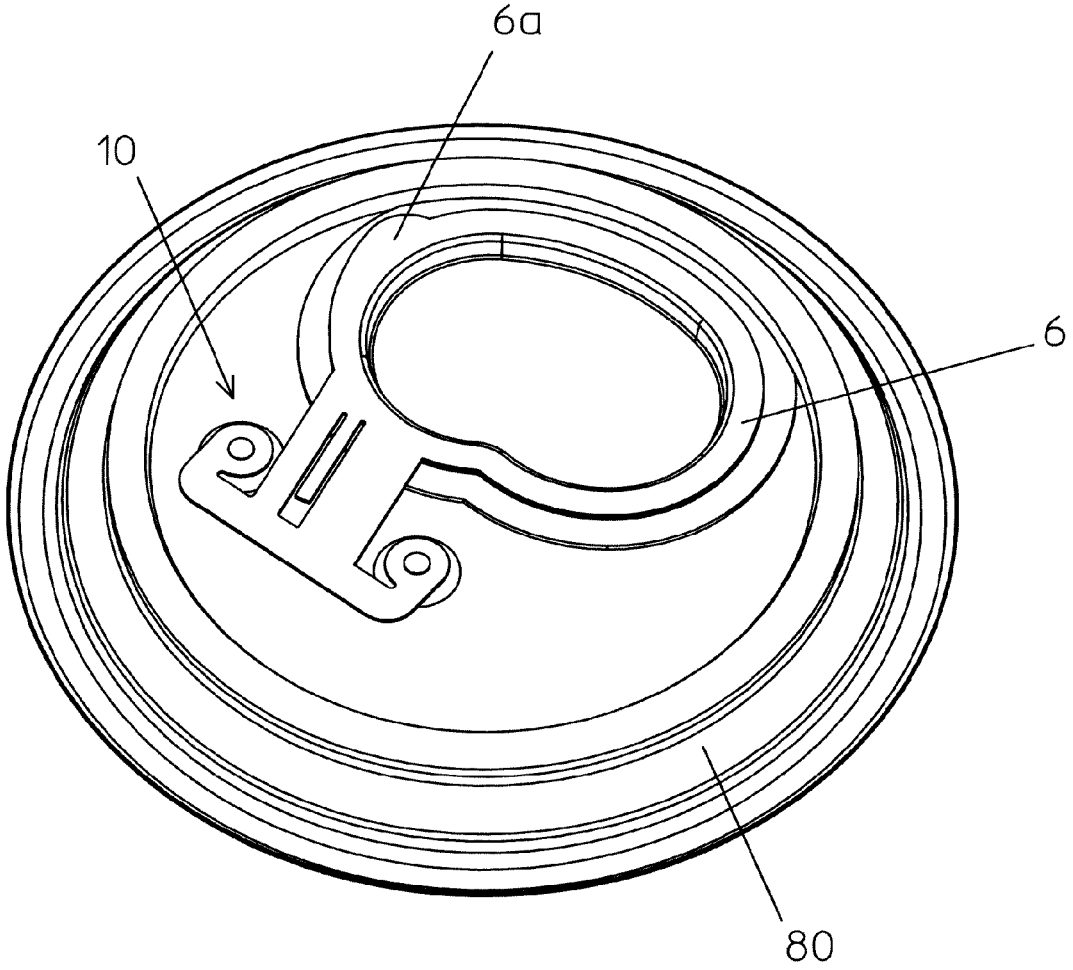

In the embodiment illustrated by FIGS. 11 to 13, the shut-off valve 6 is part of the elastic resilient element 10. In one embodiment, both are made of steel. FIG. 11 shows the separate elements of this embodiment. The intermediate element 80 has a circumferential portion 80*a* that will be attached to the can end by seaming. Further, in the shown embodiment, intermediate element 80 has two mushroom elements 106 and 107 that are snapped into holes 96 and 97 of elastic resilient element 10, thus fastening the elastic resilient element 10 to the intermediate element 80. A seal 19 of shut-off valve 6 is shown, sealing the opening in the intermediate element 80 that is closed by shut-off valve 6. In some embodiments, this seal 19 of the shut-off valve may be integrated in the shut-off valve.

As is shown in FIG. 11, elastic resilient element 10 has a portion 10' that is located across the mushrooms 106, 107 that act as hinge points when the shut-off valve is opened; the shut-off valve in an opened position is shown in FIG. 12. Thus, while one portion of the elastic resilient element 10, and the shut-off valve 6, are on one side of the hinge points, the other portion 10' of the elastic resilient element 10 is on the other side of the hinge points, opposite to the one side. An advantage of such a configuration of the elastic resilient element 10 is that the elastic resilient element is flexible so that, when opening the can for the first time, the difference in location of the hinge points of the cap top 3 and the shut-off valve 6 can be compensated for: in fact, when opening the can for the first time by actuating pull tab 4 (see FIG. 1*a*), the cap top 3 rotates around a center of rotation that is different from the hinge points around which the shut-off valve rotates, and the cap top 3 is fastened to the shut-off valve.

In the embodiment shown in FIGS. 11-13, elastic resilient element 10 has holding means 32 for holding the shut-off valve 6 in the opened position when opening the can. When opening the can, by actuating pull tab 4 (FIG. 1*a*), engaging means 32 (FIG. 11), which is a bent strip portion of elastic resilient element 10 in the shown embodiment, engages with other engaging means 88, which is a hole 88 in the intermediate element 80 in the embodiment of FIG. 11, and in this way the shut-off valve 6 is blocked in a fixed position and the drinking or pouring aperture of the can stays open. FIG. 12 shows this opened position, wherein engaging means 32 engages with the other engaging means 88; in the shown embodiment, strip 32 is fixed in hole 88. To close the can again, in one embodiment the customer may push on the rivet fixing the pull tab to the can end (mushroom B and cavity 40B in FIG. 6); strip 32 is then released from hole 88. In another embodiment (not shown in the drawings), as other engaging means 88, instead of a simple hole 88, a slit comprising teeth is used, just like in a cable-tie or zap-strap for bunching electric cables. The customer can now, by actuating the pull tab, open the can further and further, and each time the strip 32 engages with a next tooth in the slit and the shut-off valve 6 is opened further. In this way, several blocked opened positions of the shut-off valve 6 may be obtained.

In an embodiment, shut-off valve 6 may be asymmetric. This is the case in the embodiment shown in FIGS. 11-13, wherein shut-off valve 6 comprises a portion 6*a* (see especially FIG. 13). An advantage of such an asymmetric shut-off valve is that tearing off cap top 3 completely from the can is facilitated; it avoids that a last, possibly small, portion of cap top 3 would remain attached to the can end 2. Alternatively, the elastic resilient element 10 may be asymmetric. In one embodiment, both shut-off valve 6 and elastic resilient element 10 are asymmetric (see e.g. FIGS. 11 and 13, wherein the strips of elastic resilient element 10 on opposite sides of strip 32 have different widths).

Figure 14:
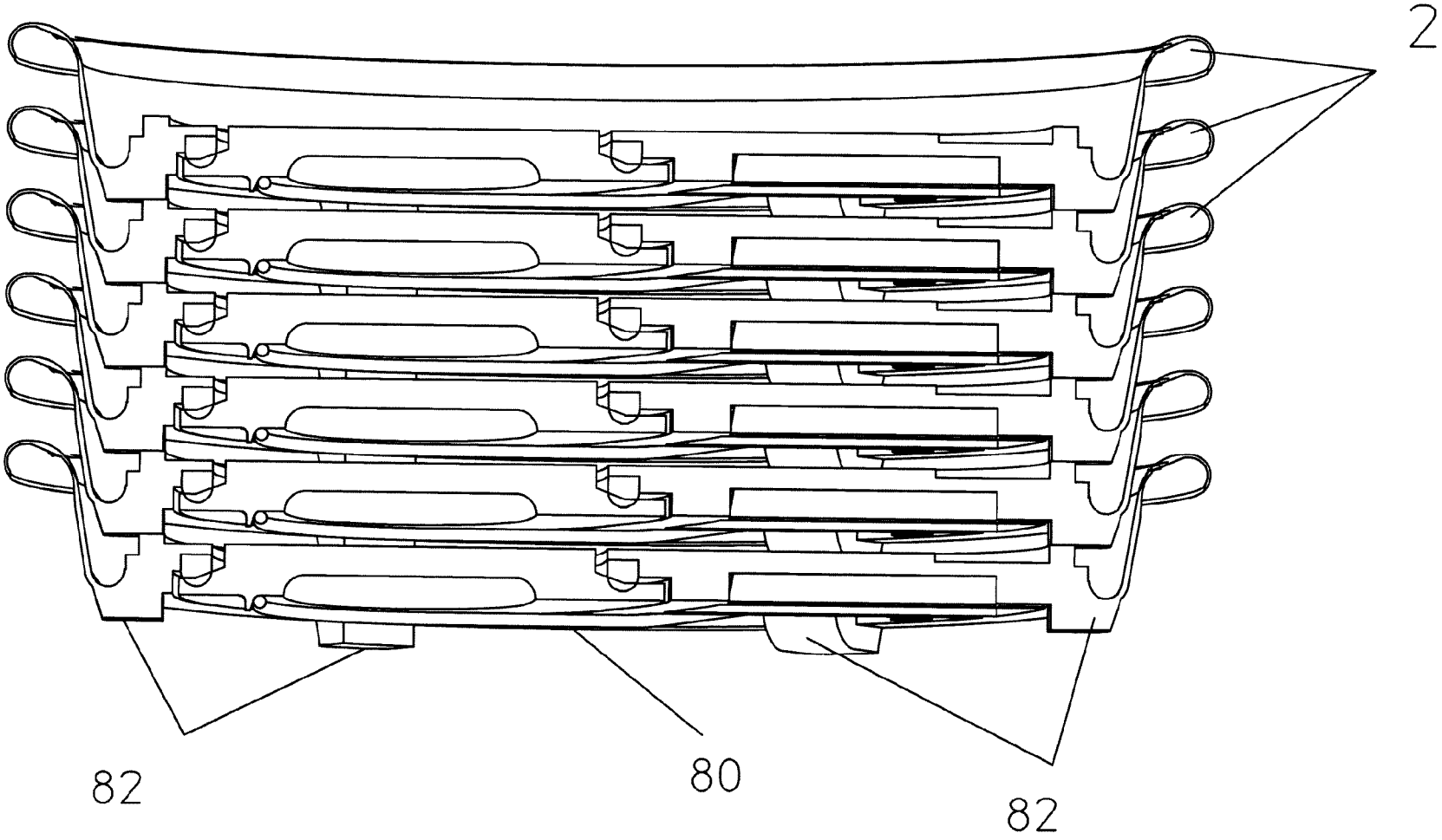
FIGS. 14 to 17 show several embodiments wherein can ends that include intermediate elements are stacked one on top of the other

FIGS. 14 to 17 show several embodiments wherein can ends 2 are stacked one on top of the other. Intermediate element 80 comprises a plurality of protrusions 82, spaced around the circumference of the intermediate element. The position and the shape of the protrusions 82 is such that they fit into another can end 2 of a set of can ends, so that this set forms a stack of can ends, as shown in FIG. 14.

Figure 15:
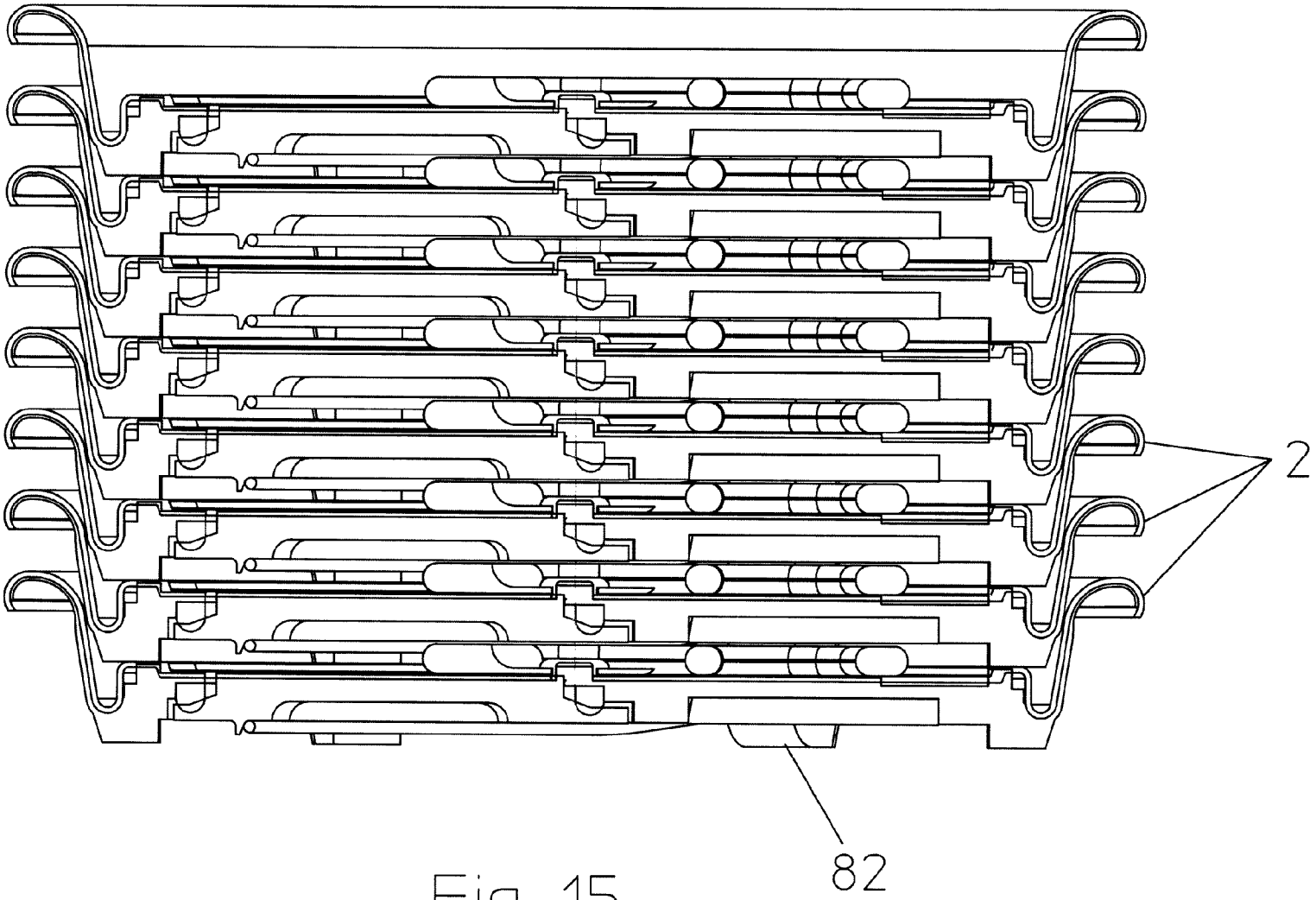

FIG. 15 shows such a set of thus stacked can ends 2, wherein the intermediate elements 80 will be attached to the respective can ends 2 by seaming.

Figure 16:
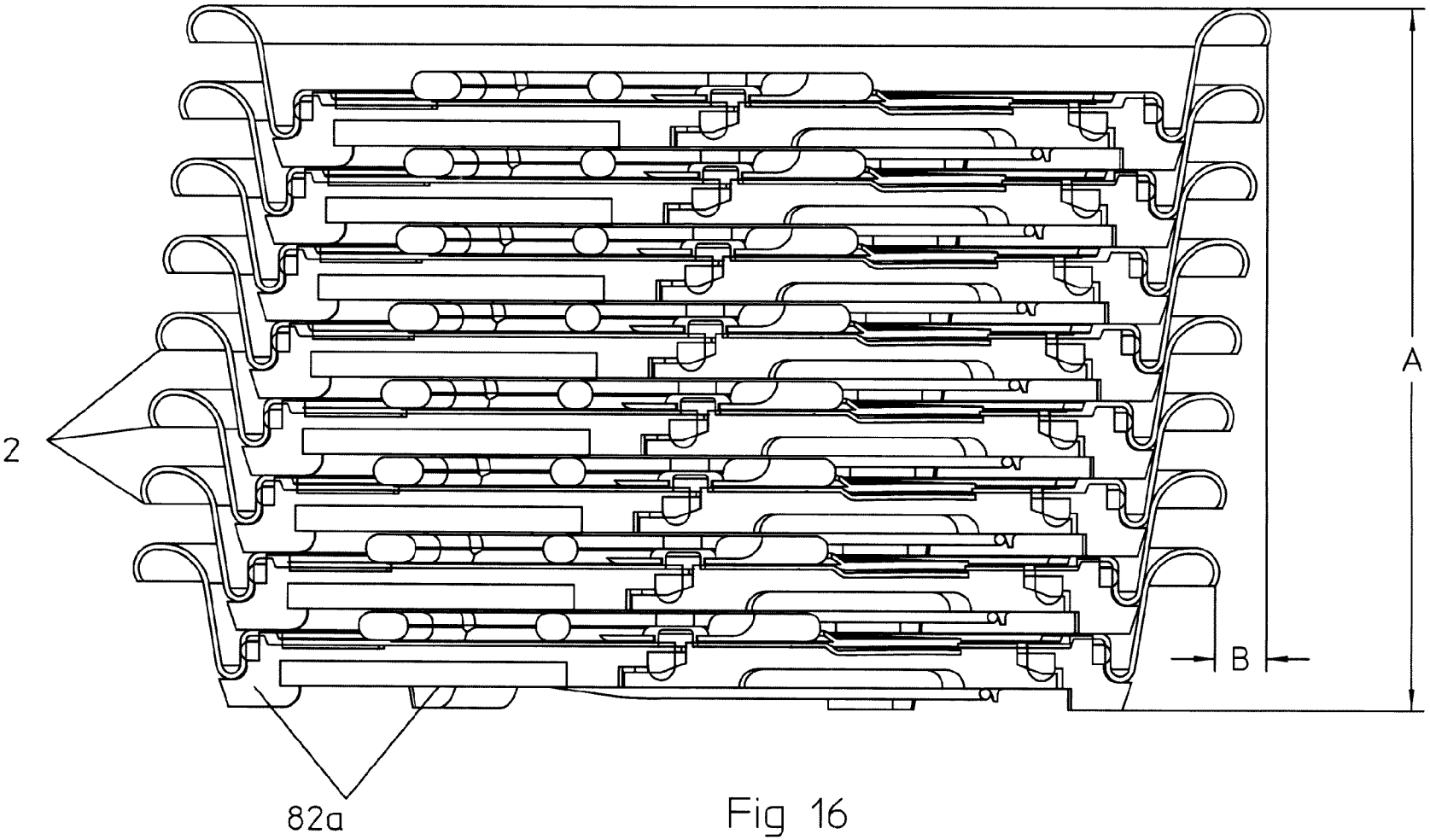

In the embodiment shown in FIG. 16, the dimensions of the protrusions 82*a* are such that there is some play between the successive can ends in the stack: as shown, in a stack of can ends 2 having a height A, the uppermost can end may be translated over a distance B with respect to the lowermost can end. This fact may be used advantageously in the production phase, when stacks of can ends are transported.

Figure 17:
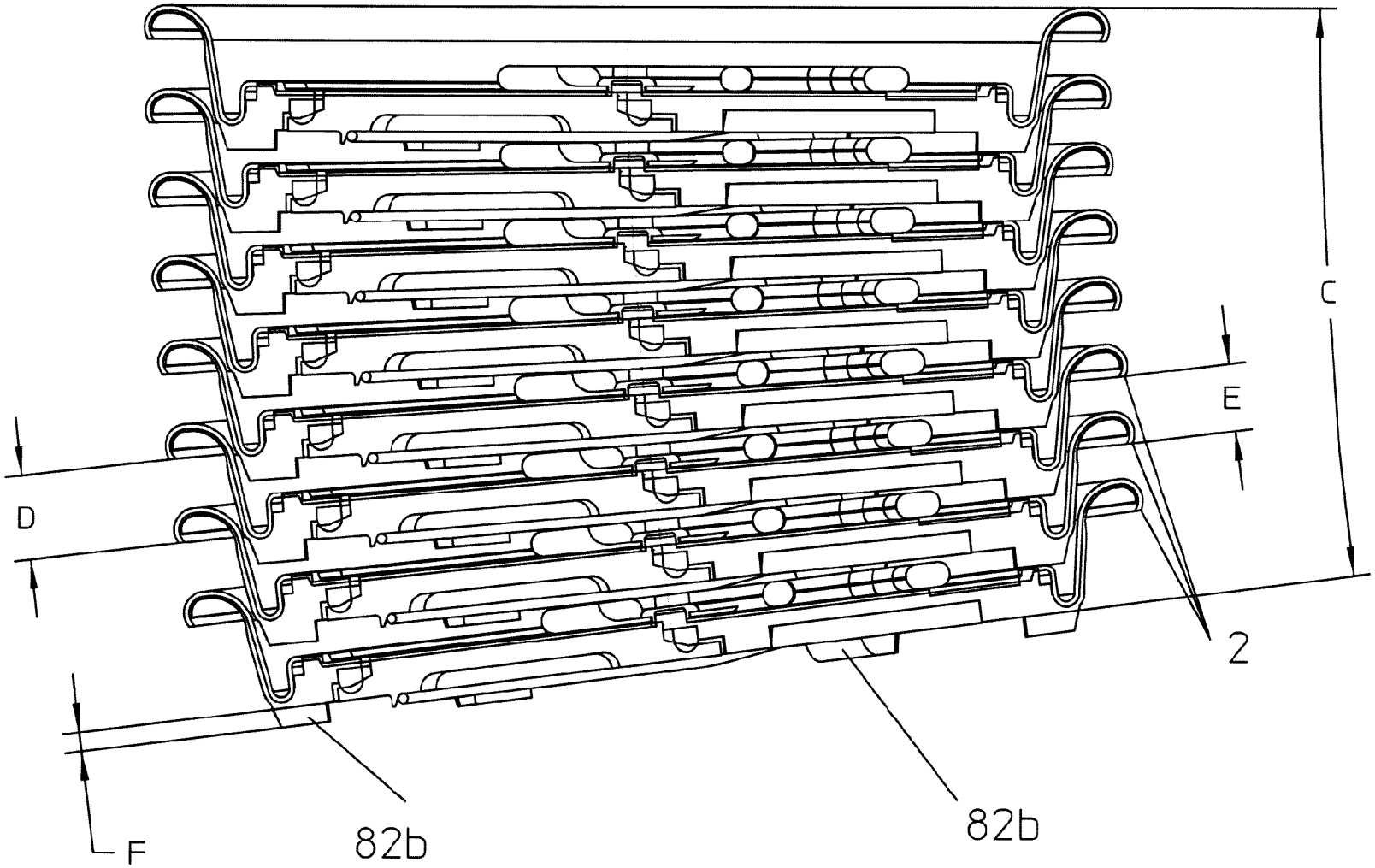

FIG. 17 shows can ends having protrusions 82*b* that have a bottom plane that is inclined under a small angle, of e.g. 1°, with respect to a horizontal plane through the can end. As shown in FIG. 14, a stack of can ends may thus be inclined, which may be advantageous when a stack of can ends is transported and has to make a turn during transportation.

Experiments

Experiments were performed to test a metal beverage can including an intermediate element in accordance with the invention, and to test especially the strength of the attachment by double seaming of a plastic intermediate element between a metal can end and a metal can body.

Tests were performed on an intermediate element without a shut-off valve in a standard beverage can, and on an intermediate element with shut-off valve and with elastic resilient element in a standard beverage can. Also, for comparison, a standard beverage can (without intermediate element) was tested. The intermediate element and the shut-off valve, when present, were made of polyacetal. The circumferential portion of the intermediate element had a thickness of 0.15 mm. The tests were performed at different temperatures and pressures.

In fact, at higher temperatures, plastics can show a flow behavior which may alter the dimensional stability of a plastic device. If afterwards and after heating, the plastic device is cooled down abruptly, these shape variations are frozen in which can compromise the functioning of the device. A similar effect can occur with the plastic intermediate element. If for instance a filled drinking can is stored in a sun heated car and if it is all of a sudden put into a refrigerator, similar shape variations can be expected. The purpose off the tests is to estimate the influence of the plastic flow and its effects on the strength of the seam and on the tightness of the intermediate element.

First, experiments were performed at 60° C.

For these experiments, a "Bain Marie" system was used, wherein the can was placed in a water filled boiler with a content of 10 liter. The water temperature was controlled with a thermostat and bi-metal system. To keep the temperature variations small, the boiler was mounted in a second thermal insulated tank with a content of 75 liter. In this way the maximum temperature variations were reduced to 1° C. A circulation pump was used for homogenizing the water temperature. All cans to be tested were fully immersed in the water and were fitted at the bottom (i.e. the side opposite to the can end) with a viton sealed O-ring coupling. Through a pressure valve and through this coupling, pressurized air was applied to the can. For safety reasons, the tested cans were half filled with water. Water temperature and can pressure were continuously monitored by means of a Keller gauge and logged by a PC.

Figure 18:
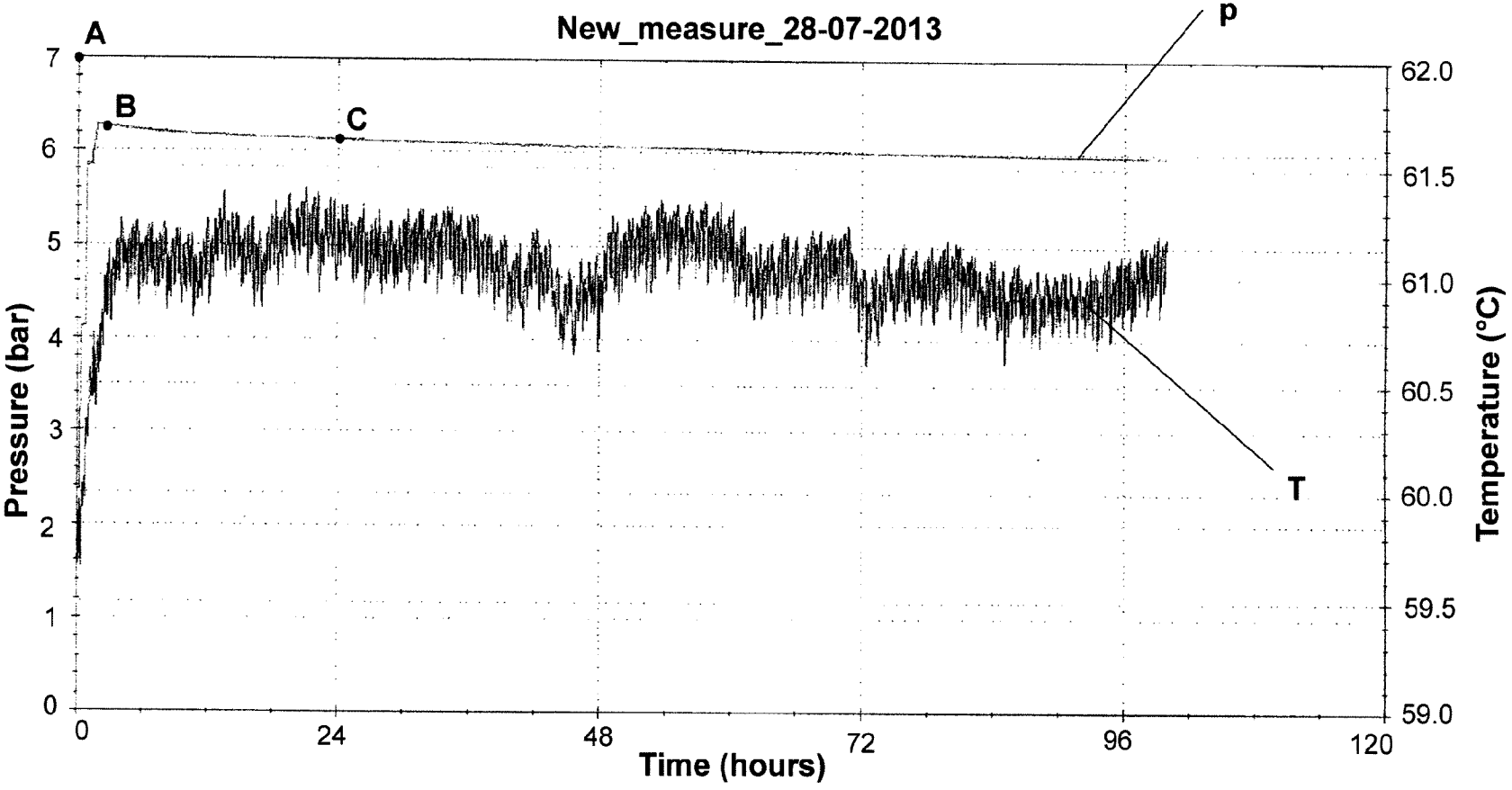
FIGS. 18 to 24 show measurement results of experiments.

FIG. 18 shows the pressure (p) and the temperature (T) as a function of time over a period of 100 h. For this 100 h test, a standard can body and can end were used together with an intermediate element without shut-off valve. The can end, the circumferential portion of the intermediate element and the can body were seamed together with a Laniko lab seamer. Since the shut-off valve was removed from the intermediate element, the pressure is evenly applied to the inside of the can body, the end and the seamed intermediate element. As can be deduced from FIG. 18, the starting pressure was 6.25 bar. From previous experiments at these pressures and temperatures, it was learned that if these pressures are abruptly applied, the can body is prone to rupture. For that reason the starting pressure of 6.25 bar was built up slowly over a period of 3 h after which the pressure valve was closed (so that no more pressurized air was applied) and pressure variations were monitored as a function of time. After approximately 90 h, the pressure seems to stabilize at 6 bar. The observed pressure decay is probably due to can deformation by metal creep giving rise to an increase in volume which explains the decrease in pressure. The observed metal creep is a non-continuous effect and in the time range between 71 h 47 and 79 h 31, i.e. a period of 8 h, no pressure variation is seen within the accuracy of the pressure gauge. This suggests that over that 8 h period, no creep is active, but it also suggests that there are no leaks and that consequently the seaming attachment is leak tight. This test was aborted after 100 h of testing after which a total pressure drop of 0.29 bar was measured. However, FIG. 18 also shows that after 100 h of testing, the pressure variations become very small indicating that the system is quasi leak tight, including the attachment by seaming.

Figure 19:
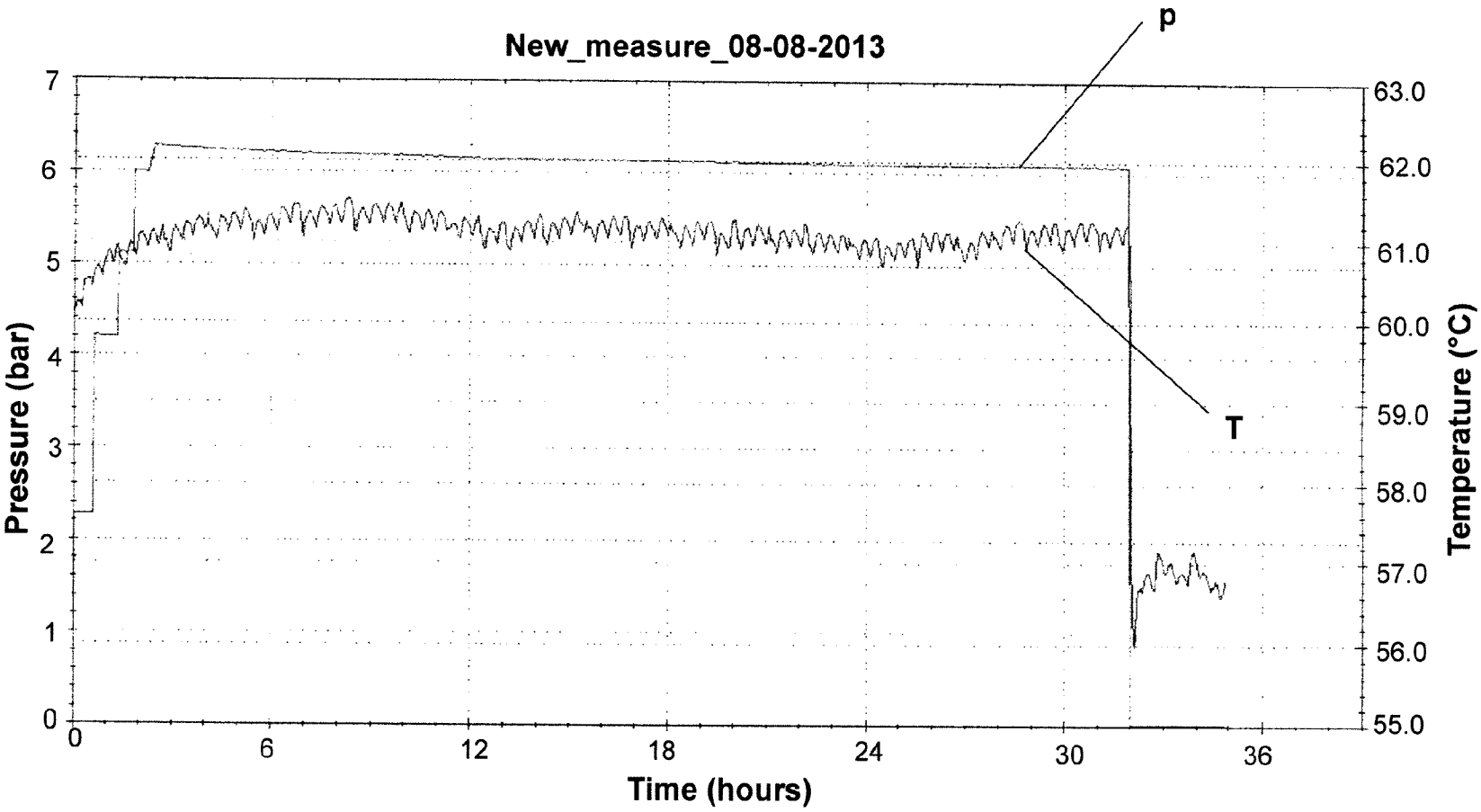

The same testing was done with a standard can, meaning that in this case no intermediate element was used and that only the can body and the end were seamed together with, as usual, a thin silicone liner as extra sealant. Starting pressure was taken at 6.26 bar and temperature remained at 60° C. As is seen in FIG. 19, the overall behavior is the same as in the previous experiment, but rupture of the seam occurred after 32 h of testing showing the better performance of the seamed attachment in the embodiment according to the invention.

Figure 20:
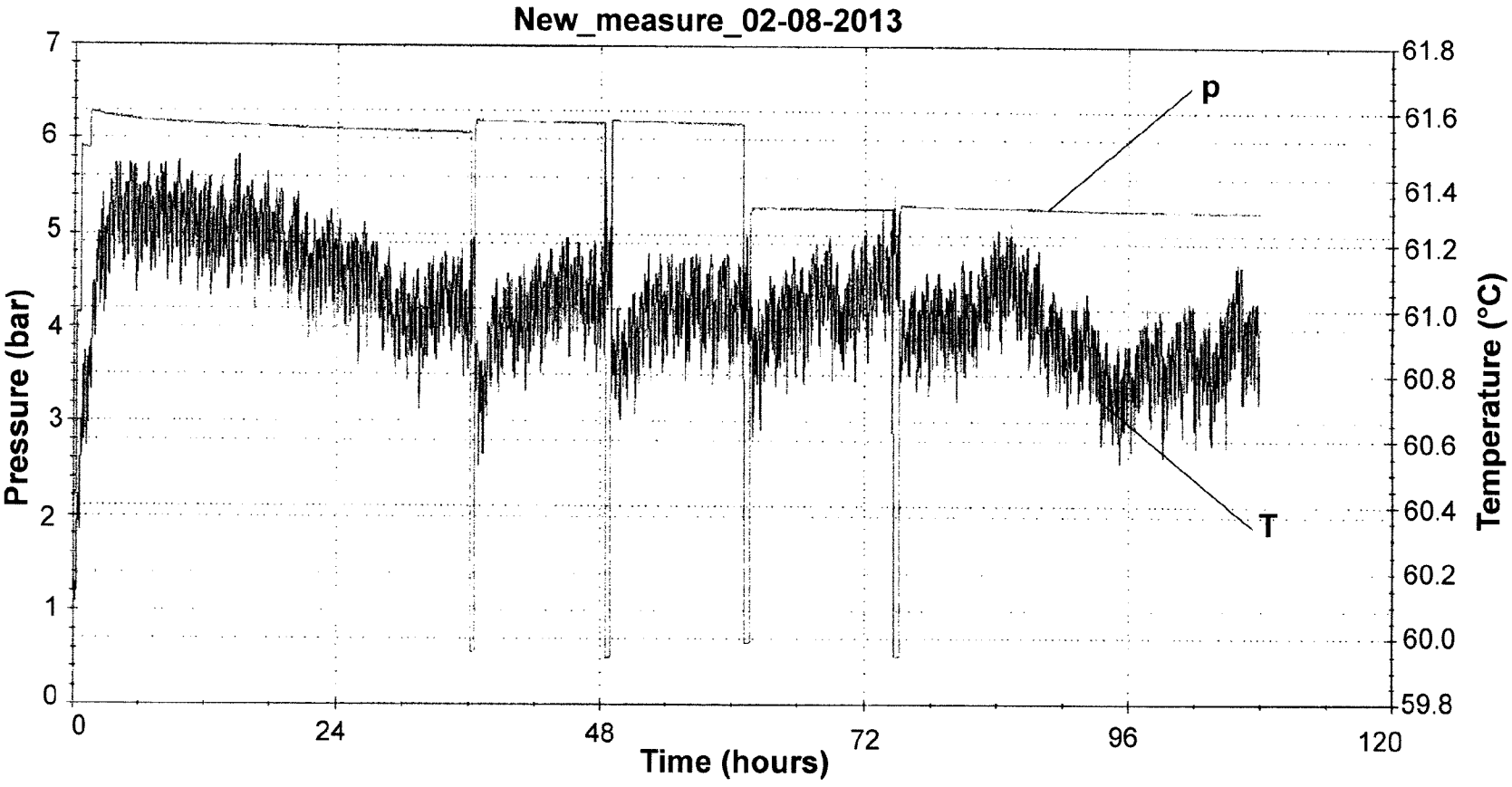

FIG. 20 shows the results for a similar experiment in which a new can was prepared identical to the can used previously in the experiment of FIG. 18. Now, however, the possible influence of intermediate venting was assessed. For that purpose, the pressure was suddenly reduced down to 0.3 bar for a period of 20 minutes after which the can was again pressurized (see the graph with pressure p). In the first two venting sequences at 36 h and 48 h the can was again pressurized to the pressure just before venting and no difference in behavior is noticed compared to the experiment of FIG. 18. Thus, the combined action of temperature, venting and pressurizing has no influence on the tightness of the seaming of the circumferential portion of the intermediate element and no harmful effects due to for instance plastic flow and permanent plastic deformation at 60° C. compromise the sealing quality of the attachment by seaming. In the two last venting sequences, respectively at 62 h and 75 h, the can is again pressurized but at pressures of approximately 5.27 bar. As can be seen from FIG. 20, this reduced pressure results in an almost flat pressure behavior. In fact, in that time range, one can define a region of approximately 9 h (65 h 50 - - - 74 h 29) over which the pressure remains constant within the accuracy of the pressure gauge. A similar zone with a length of 8 h is found in the time range from 99 h 13 up to 107 h 43. As previously discussed, this strongly suggests that over these periods of time there is no metal creep visible but again that the seaming attachment of the intermediate element is leak tight at these temperatures of 60° C.

Subsequently, experiments were performed at 2° C.

Figure 21:
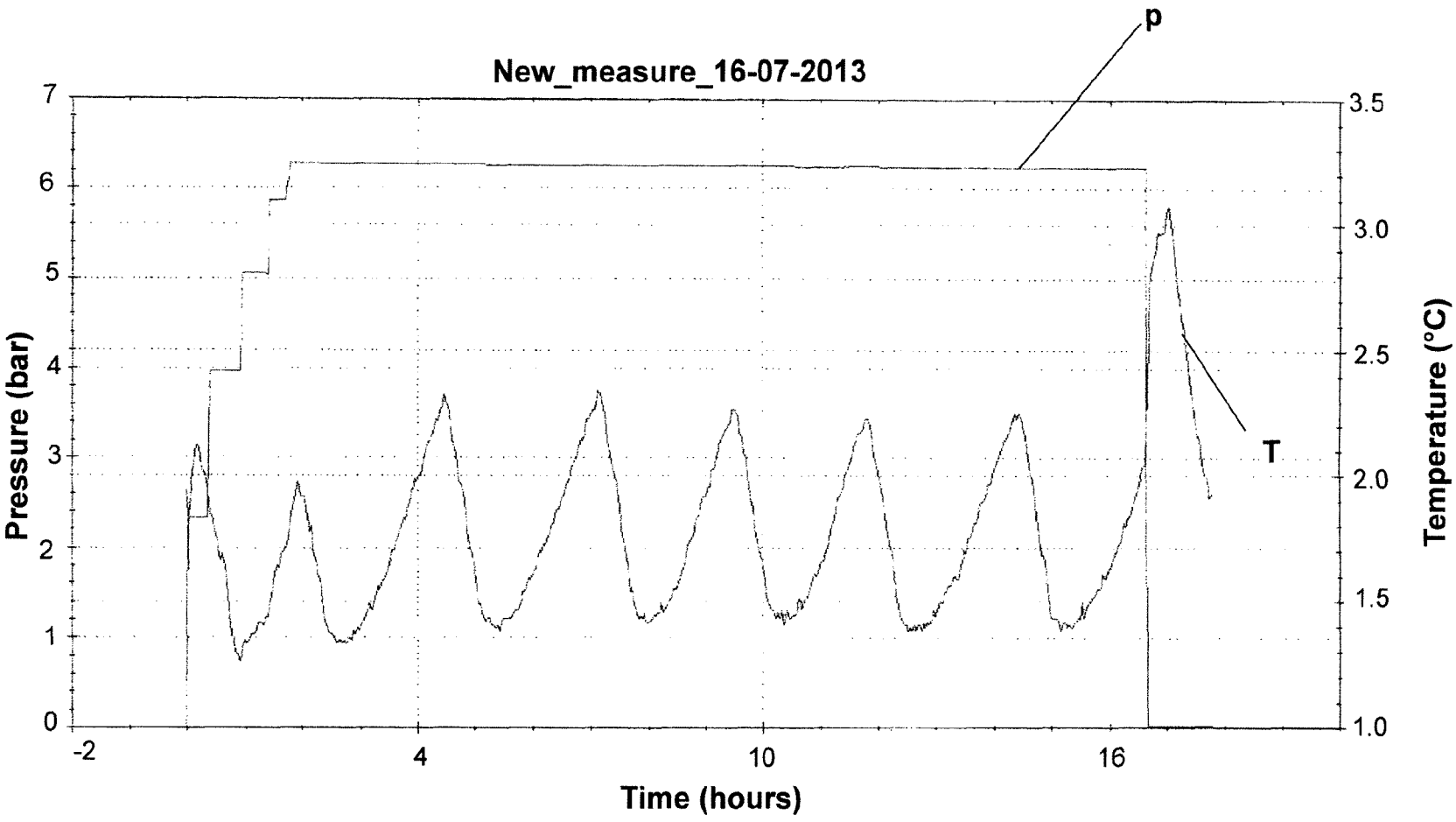

For these experiments at 2° C., the cans under test were immersed in a 30 liter tank which was placed in a refrigerator system kept at 2° C. The measuring system was similar to the one used for the 60° C. tests, as well as the pressurizing system. The cans tested were prepared in a similar way as previously described i.e. with the intermediate element but without the shut-off valve. In a first test, of which the measurement results are shown in FIG. 21, the starting pressure was taken at 6.26 bar again with a build up time of 3 h. The pressure versus time behavior is shown in FIG. 21. As can be seen, the pressure remains nearly constant and creep effects are hardly visible. However, under the given conditions of pressure and temperature no long term experiments could be performed due to failure of the groove along the cap top after 16 h 37 of testing. Indeed, at this temperature and pressure charging a rupture of the predefined groove along the cap top was always observed within a test period between 16 h-17 h. The seaming on the contrary shows no deterioration.

Figure 22:
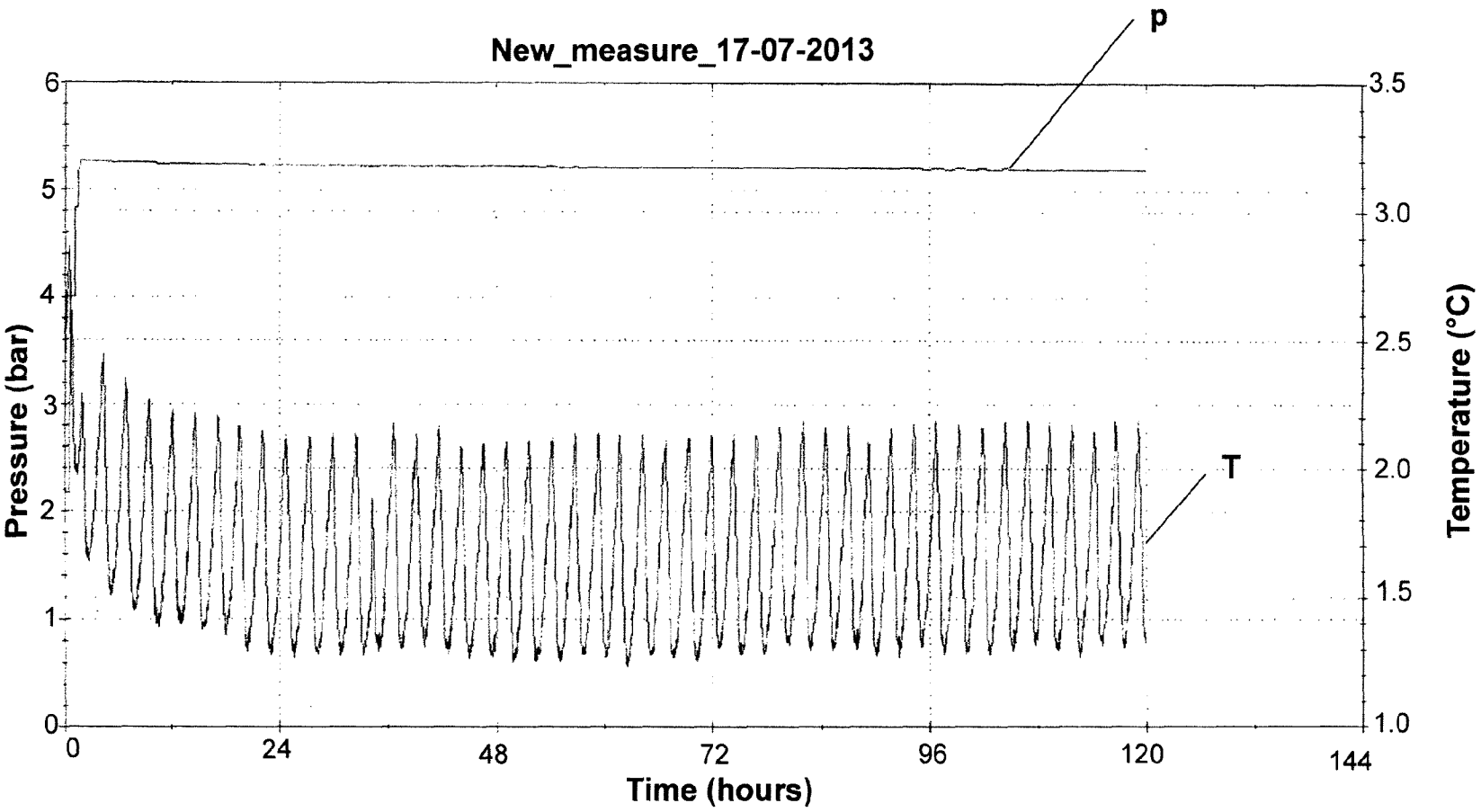
Figure 23:
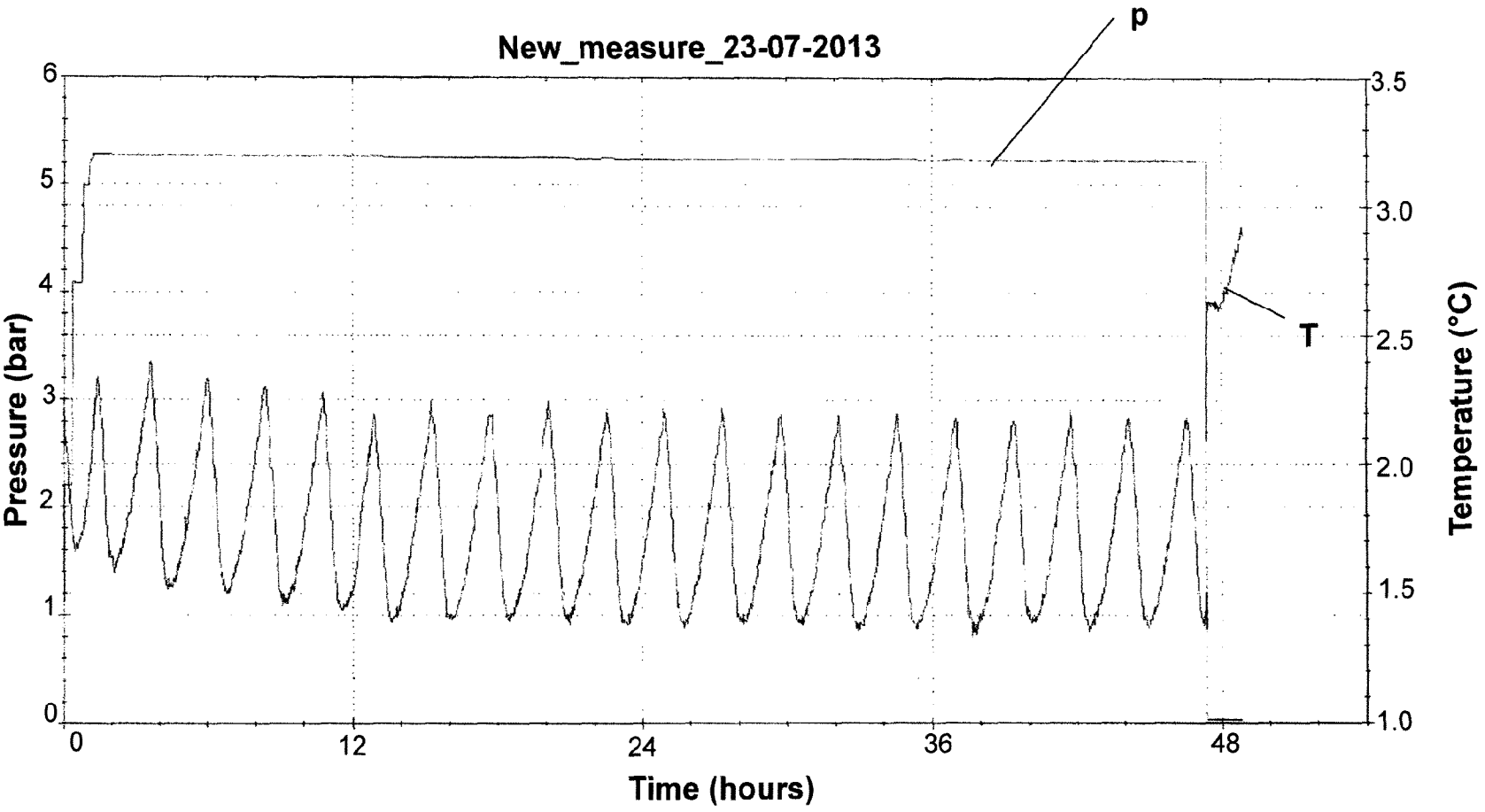

In order to get a better insight in the pressure behavior at 2° C. a second experiment at that temperature was performed with a similarly prepared test can. However, the starting pressure was taken at 5.26 bar instead of 6.26 bar. Over a period of 120 h, after which the test was aborted, no damage was observed neither at the predefined groove nor at the seaming. As can be seen from FIG. 22, the total pressure drop over that period of 120 h becomes very small and amounts to only 0.06 bar. This corresponds to a mean pressure drop of 0.01%/h relative to the starting pressure. Again there is a time range of 14 h (103 h13 - - - 117 h 19) over which the pressure remains constant within the accuracy of the pressure gauge giving evidence for the tightness of the system. In order to further evaluate the quality at 2° C. of the seaming attachment, as compared to the classic seaming with a silicone liner, a similar test as the previous one was set up using however the classic seaming approach with silicone liner as in a standard beverage can (i.e. without intermediate element). As is seen in FIG. 23, again a starting pressure of 5.26 bar was used and after approximately 48 h under pressure, the classic seam collapses. The used values of temperature and pressure are probably rather unrealistic for daily life applications, but nevertheless, these experiments show the quality of the seaming technique when applied to the intermediate element.

Tightness testing of the shut-off valve.

Figure 24:
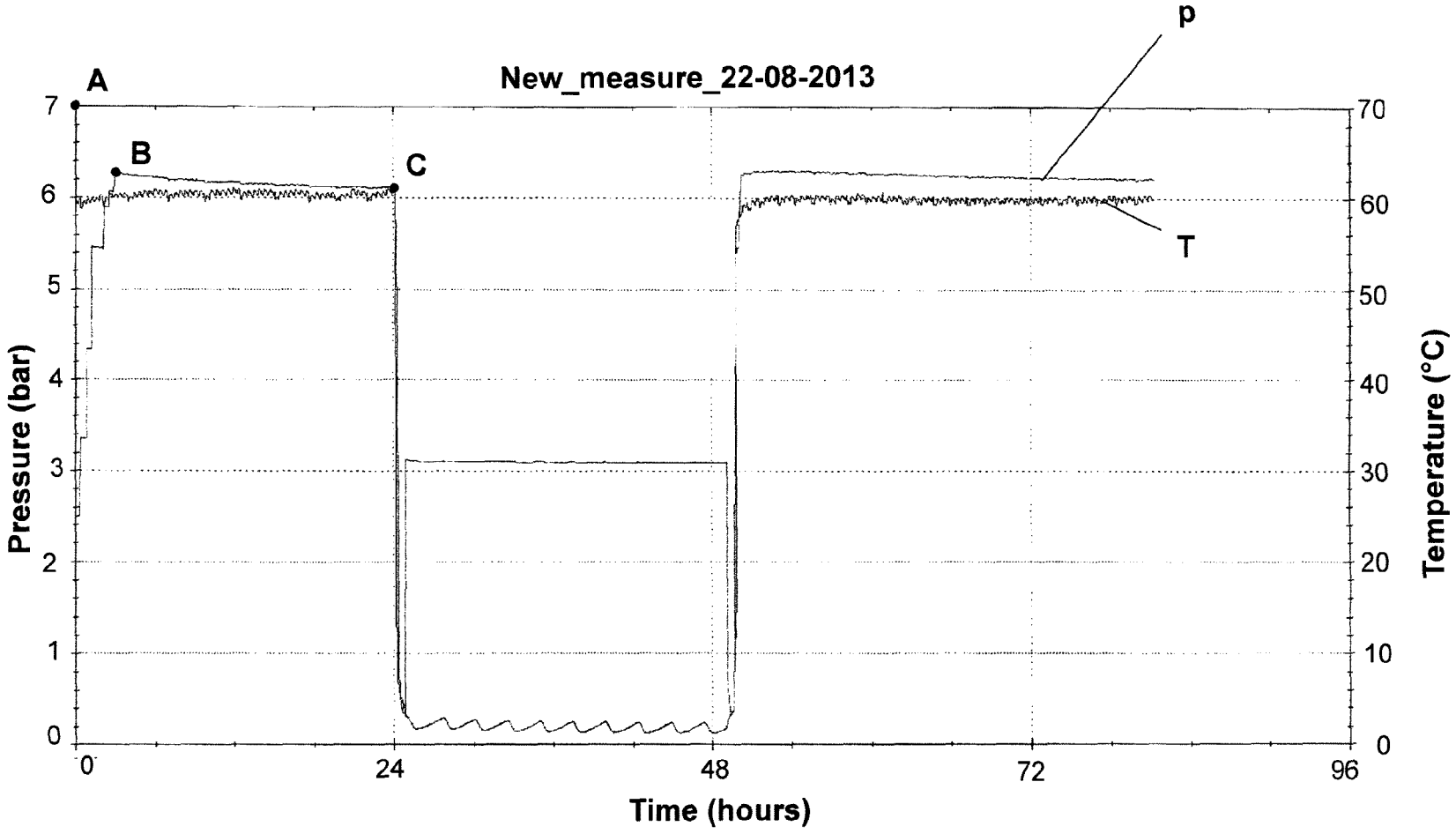

For these tests, cans were used with intermediate element including shut-off valve and elastic resilient element. The cap top was removed which allowed to control the tightness of the shut-off valve. As is seen in FIG. 24, in the first period of 24 h the can was kept at 60° C. and a starting pressure of 6.27 bar was applied. As can be seen, the pressure behavior follows closely that of FIG. 18 obtained under similar circumstances (see points A, B and C). In the test described in FIG. 18 (intermediate element without shut-off valve) the tightness of the seaming attachment is tested and proved to be reliable. In the test of FIG. 24 (intermediate element with shut-off valve, but cap top removed) the tightness of both the seaming attachment and the shut-off valve is tested. From the previous test, shown in FIG. 18, it was concluded that the seaming attachment is quasi leak free, and so it must also be in the test of FIG. 24 (see also to the similarity of the pressure versus time behavior). Therefore, one must conclude that under the given circumstances, the shut-off valve is also leak tight.

After 24 h, the can was vented down to a pressure of 0.34 bar and the temperature was reduced to approximately 2° C. After this venting sequence, the pressure was increased to 3.1 bar while keeping the temperature at 2° C. for another 24 h. In that time period, one could expect possible malfunctioning of the closing system due to non-elastic behavior or plastic flow occurring in the previous 24 h period at 60° C. and at a pressure of 6 bar. As can be seen from FIG. 24, and within experimental error, the pressure remains constant over 24 h indicating that the intermediate element with shut-off valve is also leak free under these circumstances. In that time period a pressure of 3.1 bar was used as this pressure coincides more or less with normal can pressures. After a total elapsed time of 50 h the can was again vented, pressurized at 6.27 bar and heated up to 60° C. The pressure behavior measured afterwards again closely matches the behavior of the test corresponding to FIG. 18, also suggesting the good tightness of shut-off valve even under these demanding conditions of pressure and temperature.

The present invention is not limited to the embodiments described above. The scope of the present invention is defined by the appended claims.

The invention claimed is:

1. An intermediate element for a can end for a metal beverage can, wherein said intermediate element is adapted to be immovably attached to said can end for shielding said can end circumferentially from the interior of said can, thus preventing the contents of said can from circumferentially passing said intermediate element to contact said can end, before use of said can by a customer and when drinking or pouring the contents of said can by said customer, wherein said intermediate element further comprises:

a shut-off valve for sealing a drinking or pouring aperture of said can, wherein said drinking or pouring aperture is for said drinking or pouring the contents of said can; and an elastic resilient element for resiliently operating said shut-off valve;

wherein said shut-off valve is configured to seal said drinking or pouring aperture by contacting said intermediate element, and wherein the intermediate element has a circumferential portion for being seamed to the can end and to a can body along an entire circumference of said can end and said can body.

2. Intermediate element according to claim 1 wherein said intermediate element has a side for contacting said contents of said can before said use of said can by said customer and wherein said shut-off valve is configured to seal said drinking or pouring aperture by contacting said side of said intermediate element.

3. Intermediate element according to claim 1 wherein said intermediate element is adapted to be immovably attached to said can end by seaming.

4. Intermediate element according to claim 1 wherein said intermediate element is adapted to be immovably attached to said can end by an adhesive, or by riveting, or by clamping, or by snapping, or by crimping, or by a combination of these.

5. Intermediate element according to claim 4 comprising a sealing element for said shielding said can end circumferentially from the interior of the can, wherein said sealing element is attached to said intermediate element.

6. Intermediate element according to claim 1 wherein said intermediate element is made by injection molding.

7. Intermediate element according to claim 1 wherein said intermediate element is at least substantially made of at least one plastic material or of at least one metal.

8. Intermediate element according to claim 1 wherein said shut-off valve is at least substantially made of at least one metal or of at least one plastic material.

9. Intermediate element according to claim 1 wherein said elastic resilient element has a holding element for holding said shut-off valve in an opened position, when said drinking or pouring aperture is opened.

10. Intermediate element according to claim 9 further comprising an engaging element for engaging with said holding element.

11. Intermediate element according to claim 1 wherein said shut-off valve is asymmetric or wherein said elastic resilient element is asymmetric.

12. Intermediate element according to claim 1 further comprising a plurality of protrusions for stacking a set of said can ends.

13. Can end comprising an intermediate element according to claim 1.

14. Can end according to claim 13 further comprising a cap top, arranged in connection to a pull tab configured to remove said cap top from a top portion of said can end along a pre-defined groove on the top portion, to thereby create said drinking or pouring aperture, wherein said cap top is configured to remain located, after said removal, on top of said shut-off valve.

15. A metal beverage can, comprising a can body and a can end according to claim 13.

16. A method for producing a metal beverage can, the can comprising a can body and a can end, the method comprising:

producing the can end for the metal beverage can, said can end comprising an intermediate element, wherein the intermediate element is adapted to be immovably attached to said can end for shielding said can end circumferentially from the interior of said can, thus preventing the contents of said can from circumferentially passing said intermediate element to contact said can end, before use of said can by a customer and when drinking or pouring the contents of said can by said customer, wherein said intermediate element further comprises: a shut-off valve for sealing a drinking or pouring aperture of said can, wherein said drinking or pouring aperture is for said drinking or pouring the contents of said can; and an elastic resilient element for resiliently operating said shut-off valve; and wherein said shut-off valve is configured to seal said drinking or pouring aperture by contacting said intermediate element;

producing the can body;

attaching the can end to the can body, wherein the intermediate element has a circumferential portion that is seamed to the can end and to the can body.

17. Method according to claim 16 further comprising producing said intermediate element by injection molding.

18. A method for using a reclosing metal beverage can, said can comprising a can body and a can end, said can end comprising an intermediate element, wherein the intermediate element is adapted to be immovably attached to said can end for shielding said can end circumferentially from the interior of said can, thus preventing the contents of said can from circumferentially passing said intermediate element to contact said can end, before use of said can by a customer and when drinking or pouring the contents of said can by said customer, wherein said intermediate element further comprises: a shut-off valve for sealing a drinking or pouring aperture of said can, wherein said drinking or pouring aperture is for said drinking or pouring the contents of said can; and an elastic resilient element for resiliently operating said shut-off valve; wherein said intermediate element has a circumferential portion that is seamed to the can end and to the can body; and wherein said shut-off valve is configured to seal said drinking or pouring aperture by contacting said intermediate element; the method comprising:

actuating a pull tab of said can end, thus removing a cap top from a top portion of said can end along a predetermined groove of said can end, thus creating said drinking or pouring aperture;

resiliently opening, by said actuating said pull tab, said shut-off valve, wherein said removed cap top remains located on top of said shut-off valve.

* * * * *